US010183206B2

(12) United States Patent
Nelson et al.

(10) Patent No.: US 10,183,206 B2
(45) Date of Patent: Jan. 22, 2019

(54) NET STRUCTURE WITH A SLIDE HINGE APPARATUS

(71) Applicant: TRIAD SPORTS GROUP, LLC, Camarillo, CA (US)

(72) Inventors: David Nelson, Camarillo, CA (US); John Lucas, Camarillo, CA (US)

(73) Assignee: Triad Sports Group, LLC, Camarillo, CA (US)

( * ) Notice: Subject to any disclaimer, the term of this patent is extended or adjusted under 35 U.S.C. 154(b) by 0 days.

(21) Appl. No.: 15/645,926

(22) Filed: Jul. 10, 2017

(65) Prior Publication Data

US 2017/0304701 A1 Oct. 26, 2017

Related U.S. Application Data

(63) Continuation-in-part of application No. 15/068,354, filed on Mar. 11, 2016, now Pat. No. 9,750,996, (Continued)

(51) Int. Cl.
*A63B 63/00* (2006.01)
*A63B 69/00* (2006.01)
(Continued)

(52) U.S. Cl.
CPC ..... *A63B 69/00* (2013.01); *A63B 61/00* (2013.01); *A63B 63/00* (2013.01); *A63B 71/022* (2013.01);
(Continued)

(58) Field of Classification Search
CPC . A63B 63/04; A63B 2210/50; A63B 2210/52; A63B 2210/54; A63B 61/02; A63B 61/04; A63B 63/00; A63B 63/004
(Continued)

(56) References Cited

U.S. PATENT DOCUMENTS 3,195,898 A * 7/1965 Respini ..... A63B 63/00 135/118
4,274,632 A 6/1981 Jacobs
(Continued)

FOREIGN PATENT DOCUMENTS

| | | |
|---|---|---|
| JP | 3100716 | 5/2004 |
| JP | 2011024660 | 2/2011 |
| KR | 920008138 | 11/1992 |

OTHER PUBLICATIONS

International Preliminary Report and Written Opinion from PCT/US2012/04057, dated Dec. 12, 2013.
(Continued)

*Primary Examiner* — Mark Graham
(74) *Attorney, Agent, or Firm* — Arent Fox LLP

(57) ABSTRACT

A ball net structure arranged to be portable, collapsible, and able to be configured into different arrangements for different nets and/or different sports-related activities. The ball net structure comprising a base structure including at least one support portion, at least one base extension, and at least one base extension hinge, wherein the at least one support portion and the at least one base extension are coupled to the at least one base extension hinge. At least one rod is removably coupled to the base structure and received by a net, wherein the net is adapted to exert a force on the at least one rod causing the at least one rod to exert a force onto said base structure.

3 Claims, 10 Drawing Sheets

Related U.S. Application Data which is a continuation of application No. 13/485,775, filed on May 31, 2012, now Pat. No. 9,283,455.

(60) Provisional application No. 61/492,010, filed on Jun. 1, 2011, provisional application No. 62/377,267, filed on Aug. 19, 2016.

(51) Int. Cl.
*A63B 61/00* (2006.01)
*A63B 102/18* (2015.01)
*A63B 71/02* (2006.01)

(52) U.S. Cl.
CPC ..... *A63B 2071/026* (2013.01); *A63B 2102/18* (2015.10); *A63B 2209/02* (2013.01); *A63B 2210/50* (2013.01); *A63B 2225/055* (2013.01); *A63B 2243/0025* (2013.01)

(58) Field of Classification Search
USPC ..... 273/398–402, 395, 396; 473/478, 434, 473/435, 490, 492–495
See application file for complete search history.

(56) References Cited

U.S. PATENT DOCUMENTS

| | | | | |
|---|---|---|---|---|
| 5,080,375 | A | 1/1992 | Moosavi | |
| 5,249,796 | A | 10/1993 | Silvi | |
| 5,269,527 | A | 12/1993 | Noval | |
| 5,269,533 | A | 12/1993 | Kellams | |
| 5,539,957 | A | 7/1996 | Schmidt | |
| 5,562,288 | A | 10/1996 | Erkebaev | |
| 5,564,711 | A | 10/1996 | Scheie | |
| 5,681,045 | A * | 10/1997 | Liao | A63B 63/004 273/400 |
| 5,690,339 | A * | 11/1997 | Chen | A63B 63/004 273/400 |
| 5,746,533 | A * | 5/1998 | Schmidt | E05D 11/1007 16/319 |
| 5,816,956 | A | 10/1998 | Ellis et al. | |
| 5,839,733 | A | 11/1998 | Meeks et al. | |
| 6,371,873 | B1 | 4/2002 | Wang | |
| 6,511,390 | B2 | 1/2003 | Kim | |
| 6,672,980 | B1 | 1/2004 | Walsh | |
| 6,716,123 | B1 | 4/2004 | Chen | |
| 7,371,195 | B2 | 5/2008 | Stevens | |
| 8,216,092 | B2 | 7/2012 | Wennesland | |
| 8,216,093 | B2 | 7/2012 | Chen | |
| 8,246,496 | B2 * | 8/2012 | Holland | A63B 63/004 473/478 |
| 8,579,737 | B2 | 11/2013 | Holland | |
| 9,162,127 | B2 | 10/2015 | Holland | |
| 9,283,455 | B2 | 3/2016 | Nelson | |
| 9,750,996 | B2 * | 9/2017 | Nelson | A63B 61/00 |
| 9,795,849 | B2 * | 10/2017 | Nelson | A63B 69/00 |
| 9,795,857 | B2 * | 10/2017 | Nelson | A63B 71/022 |
| 2003/0153412 | A1 | 8/2003 | Duba et al. | |
| 2004/0036222 | A1 | 2/2004 | Chou | |
| 2007/0087869 | A1 | 4/2007 | Lin | |
| 2007/0281805 | A1 | 12/2007 | Hsiao | |
| 2010/0184538 | A1 * | 7/2010 | Reeves | A63B 63/004 473/478 |
| 2010/0304902 | A1 | 12/2010 | Holland et al. | |
| 2011/0074111 | A1 | 3/2011 | Jackson | |
| 2011/0230284 | A1 | 9/2011 | Simon | |
| 2011/0287872 | A1 | 11/2011 | Lynch | |
| 2013/0303313 | A1 * | 11/2013 | Chen | A63B 63/004 473/478 |
| 2015/0148152 | A1 * | 5/2015 | Holland | A63B 63/004 473/478 |
| 2015/0151179 | A1 * | 6/2015 | Holland | A63B 63/004 473/478 |
| 2016/0023072 | A1 | 1/2016 | Holland | |

OTHER PUBLICATIONS

Bownet, Bownet Portable Lacrosse Goal, YouTube video (Jan. 11, 2009): https://www.youtube.com/watch?v=avtL47x4yoo.
Bownet, The Bownet Will Take Abuse, YouTube video (Nov. 18, 2008): https://www.youtube.com/watch?v=0lh51KY0bFA.
Bownet, Bownet Big Mouth, YouTube video (Jan. 21, 2009): https://www.youtube.com/watch?v=D6HAraGpAdl.
Bownet, Strike Zone Set Up, YouTube video (Jan. 25, 2009): https://www.youtube.com/watch?v=Y0EJjJaVz-o.
Bownet, US Lacrosse Convention 2009, YouTube video (Jan. 26, 2009): https://www.youtube.com/watch?v=erxobnMRsfQ.
Bownet, Strike Zone Pitching, YouTube video (Feb. 18, 2009): https://www.youtube.com/watch?v=h6_84TtFUI4.
Bownet, Sandbag Demo, YouTube video (Jul. 14, 2009): https://www.youtube.com/watch?v=KraTVKH549g.
Bownet, Backstop Drills, YouTube video (Jul. 15, 2009): https://www.youtube.com/watch?v=e-26ils7tXo.
Bownet, 7×14 Training Session, YouTube video (Oct. 24, 2009): https://www.youtube.com/watch?v=y-x9GGu4aaY.
Bownet, Soft Toss and Bigmouth Demo, YouTube video (Nov. 23, 2009): https://www.youtube.com/watch?v=lGdgSoTLLNY.
Bownet, Soccer Net Demo, YouTube video (Nov. 24, 2009): https://www.youtube.com/watch?v=4LOxlwoUzRA.
Bownet, Crease Set Up-Down, YouTube video (Dec. 31, 2009): https://www.youtube.com/watch?v=nKApo0tsj1c.
Bownet, Barrier Net Soccer Demo, YouTube video (Jan. 18, 2010): https://www.youtube.com/watch?v=0NZ86SWigxM.
Bownet, DMS11 Practice, YouTube video (Feb. 19, 2010): https://www.youtube.com/watch?v=OaW5j9_FrA4.
Bownet, Final Bownet Guard1, YouTube video (Mar. 11, 2010): https://www.youtube.com/watch?v=od8OHFFM1dU.
Bownet, Bownet 8×24, YouTube video (Oct. 21, 2010): https://www.youtube.com/watch?v=XKLsGhbhRvE.
Bownet, Bownet SnapZone Set Up, YouTube video (Jan. 5, 2011): https://www.youtube.com/watch?v=MDrIqmTfHVA.
Bownet, Lacrosse Demo 2011, YouTube video (Jan. 19, 2011): https://www.youtube.com/watch?v=OAimgUUXHmk.
Bownet, Bownet Soccer Demo, YouTube video (Jan. 18, 2010): https://www.youtube.com/watch?v=ORrIbNSvhdw.
Bownet, Ladies Crease and 8m Arc Set Up, YouTube video (Nov. 9, 2011): https://www.youtube.com/watch?v=ohF81rLyTPM.
Bownet, Ladies 8m Arc Take Down, YouTube video (Jan. 30, 2012): https://www.youtube.com/watch?v=VvTZI9pYlic.
Bownet, Volleyball Setting Net Demo, YouTube video (Apr. 16, 2012): https://www.youtube.com/watch?v=FWfcXVKly28.
Bownet, Bownet Solo Kicker, YouTube video (Jan. 4, 2011): https://www.youtube.com/watch?v=-efeeqAy0xE.
Bownet, The Mini YouTube video (Nov. 18, 2008): https://www.youtube.com/watch?v=U0gBsj1Qgdg.
Bownet, Bownet Lacrosse (LAX), YouTube video (Nov. 18, 2008): https://www.youtube.com/watch?v=AJGAIG3NzdM.
Bownet, Big Mouth Drills, YouTu be video (Jan. 6, 2009): https://www.youtube.com/watch?v=XjD1EBBf3rl.
Bownet, 7×14 SetUp, YouTube video (Jul. 14, 2009): https://www.youtube.com/watch?v=hTVhyRfq5u0.
Bownet, Barrier Net Set Up, YouTube video (Feb. 28, 2010): https://www.youtube.com/watch?v=bcRc9Yy9-hc.
Bownet, 6.5×18 SetUp, YouTube video (Jul. 14, 2009): https://www.youtube.com/watch?v=Kaq3YCkObi0.
Bownet, Backstop Up & Down, YouTube video (Jul. 15, 2009): https://www.youtube.com/watch?v=gfqHjPfWuq8.
Bownet, Barrier Net 'Take Down'.mov, YouTube video (Mar. 4, 2010): https://www.youtube.com/watch?v=iyazwJe70fl.
Bownet, BowNet 5×10 shots, YouTube video (Jan. 20, 2009): https://www.youtube.com/watch?v=oDS0doGxKqU.
Bownet, BowNet 6×12 shots, YouTube video (Jan. 20, 2009): https://www.youtube.com/watch?v=KTVdKSRrPwg.
Bownet, Bownet Screen Pitching, YouTube video (Jan. 6, 2009): https://www.youtube.com/watch?v=71u-vOs3TV4.
Bownet, Lacrosse Demo.mov, YouTube video (Jan. 3, 2010): https://www.youtube.com/watch?v=ar6WspWjP3w.

(56) References Cited

OTHER PUBLICATIONS

Bownet, SetUp New 4×8, YouTube video (Jul. 14, 2009): https://www.youtube.com/watch?v=evSHIhEVcsU.
Bownet, Softtoss net set up, YouTube video (Jan. 21, 2009): https://www.youtube.com/watch?v=yD2HM9RHcxo.
Bownet, The BowNet 5×10, YouTube video (Jan. 20, 2009): https://www.youtube.com/watch?v=jP3TW1nEoEs.
Bownet, The BowNet 6×12, YouTube video (Jan. 20, 2009): https://www.youtube.com/watch?v=kipbgs1ULWA.
Bownet, 12'×3' Barrier/Tennis Net Set Up, YouTube video (Jan. 10, 2011): https://www.youtube.com/watch?v=MX08s9Djf8s.
Bownet, 18'×2' 9" Portable Barrier/Tennis Net Set Up, YouTube video (Nov. 6, 2011): https://www.youtube.com/watch?v=IOVRkq_hlXs.
Bownet, 18' Youth Tennis Net Take Down, YouTube video (Nov. 9, 2011): https://www.youtube.com/watch?v=7qySTevtZH8.
Bownet, Bownet 8×24 Set Up, YouTube video (Jan. 9, 2011): https://www.youtube.com/watch?v=Oapc5oXdhSc.
Bownet, Bownet 8×24 Take Down, YouTube video (Jan. 9, 2011): https://www.youtube.com/watch?v=CbFmS6lt0vY.
Bownet, Bownet Solo Kicker Set Up, YouTube video (Jan. 5, 2011): https://www.youtube.com/watch?v=aAQVIISKo-Y.
Bownet, Bownet Solo Kicker Take Down, YouTube video (Jan. 5, 2011): https://www.youtube.com/watch?v=Al3UBhsNVM8.
Bownet, Can't Knock Down the Bownet, YouTube video (Dec. 19, 2011): https://www.youtube.com/watch?v=0xC2xECHJ84.
Bownet, Field Hockey Take Down, YouTube video (Nov. 15, 2011): https://www.youtube.com/watch?v=zVrmvMWuF_A.
Bownet, Field Hockey Set Up, YouTube video (Nov. 15, 2011): https://www.youtube.com/watch?v=aY5Y9kpebJA.
Bownet, Hitting Station Set Up, YouTube video (Nov. 6, 2011): https://www.youtube.com/watch?v=0R2eK8xiyUY.
Bownet, Hitting Station Take Down, YouTube video (Dec. 4, 2011): https://www.youtube.com/watch?v=6E3bHzBVRL4.
Bownet, Lacrosse Halo Set Up, YouTube video (Jan. 18, 2011): https://www.youtube.com/watch?v=5jSR28apetA.
Bownet, L' Screen Set Up, YouTube video (Dec. 15, 2011): https://www.youtube.com/watch?v=id7oYUqDqlw.
Bownet, Pitching Screen Demo, YouTube video (Dec. 15, 2011): https://www.youtube.com/watch?v=-ullBby-opQ.
Bownet, QB5 Pocket Net Take Down, YouTube video (Dec. 4, 2011): https://www.youtube.com/watch?v=S4rlSPDB2nc.
Bownet, QB5 'Set Up', YouTube video (Dec. 4, 2011): https://www.youtube.com/watch?v=elGJ2sgw8GM.
Bownet, Solo Kicker Demo, YouTube video (Jun. 13, 2011): https://www.youtube.com/watch?v=4l-8PMhP5Aw.
Bownet, Volleyball Hitting Station Demo, YouTube video (Apr. 13, 2012): https://www.youtube.com/watch?v=_LieCF1_dM0.
Bownet, Volleyball Hitting Station Set Up, YouTube video (Nov. 9, 2011): https://www.youtube.com/watch?v=peQf6U2bXxE.
Bownet, Volleyball Hitting Station Take Down (Nov. 9, 2011): YouTube video, https://www.youtube.com/watch?v=-iP-BmT-72g.
International Search Report and Written Opinion for PCT/US2012/040557, dated Dec. 14, 2012.

* cited by examiner

FIG. 2c
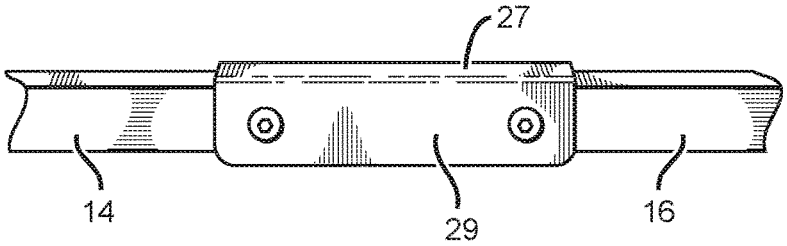
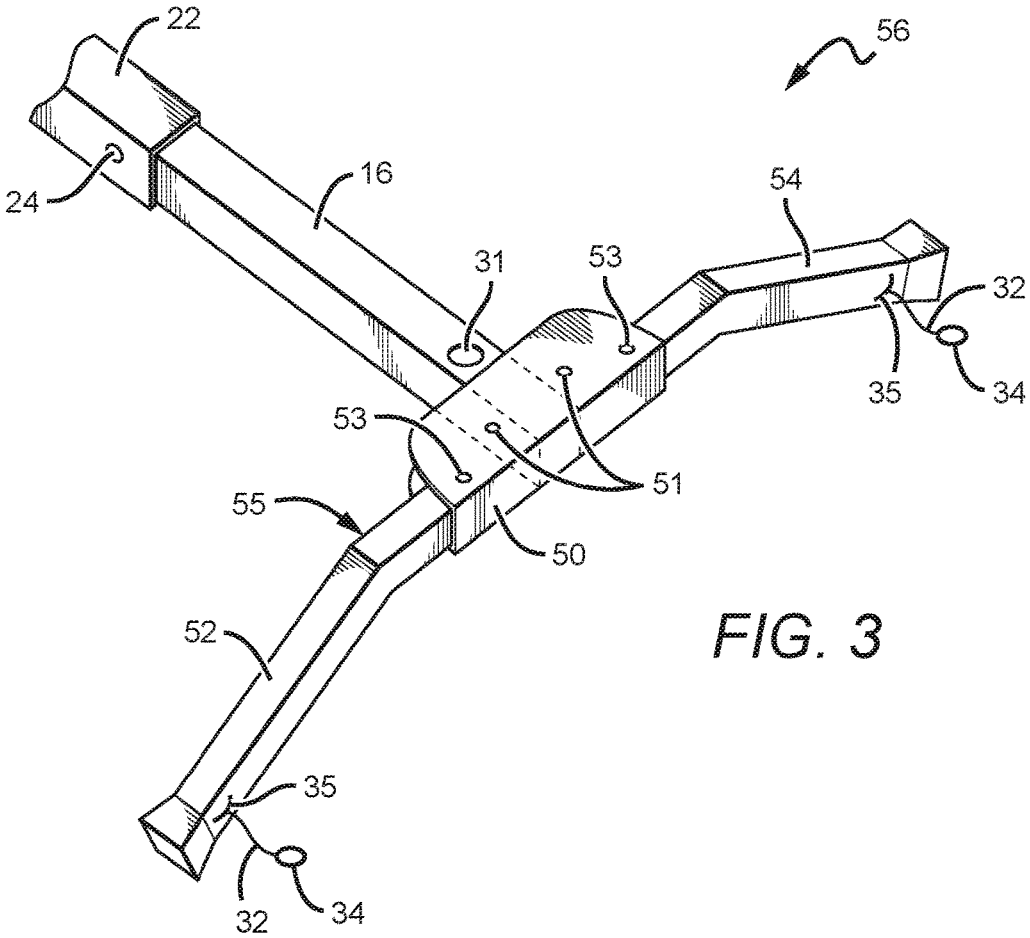
FIG. 3

FIG. 16
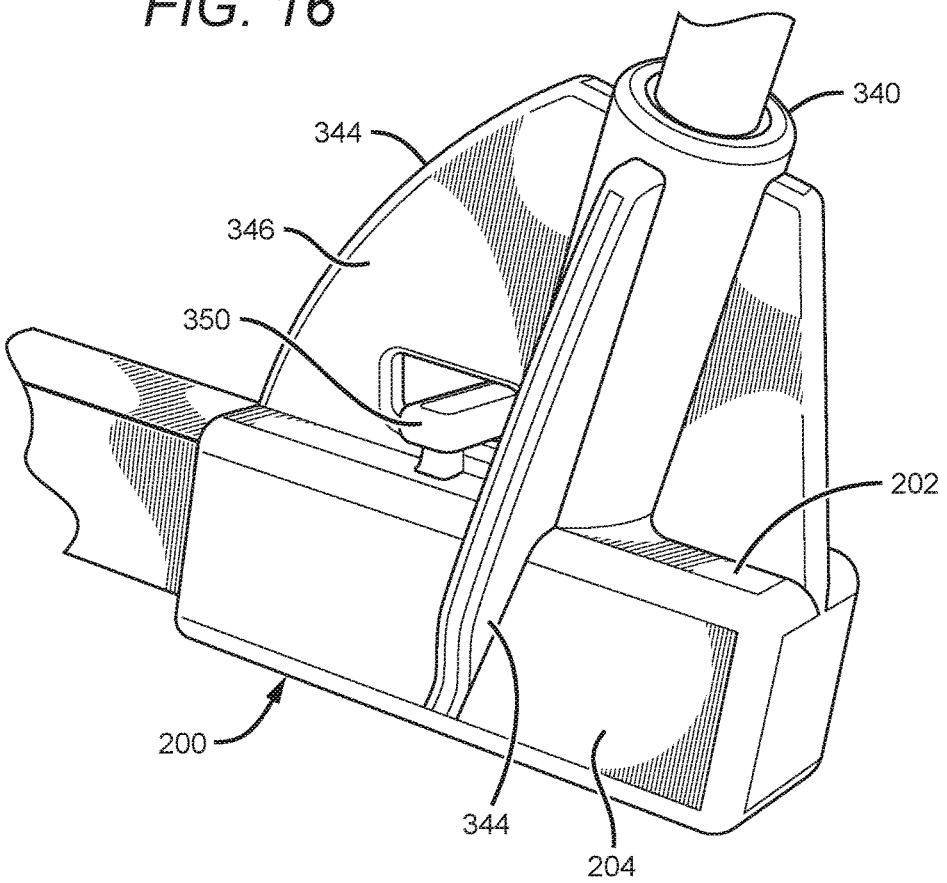
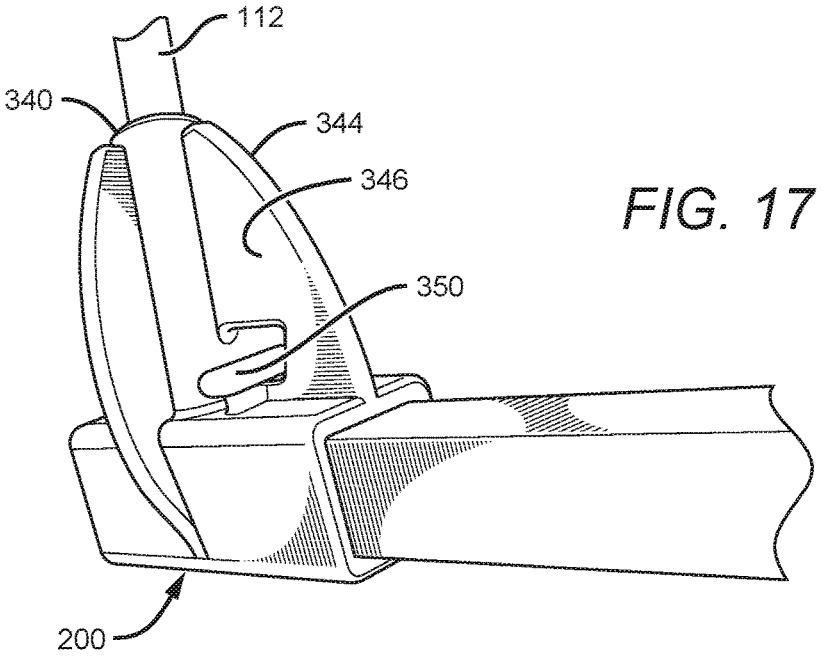
FIG. 17

NET STRUCTURE WITH A SLIDE HINGE APPARATUS

RELATED APPLICATION

This application is a continuation in part application of Ser. No. 15/068,354 to David Nelson et al., filed on Mar. 11, 2016, which is a continuation application of Ser. No. 13/485,775 to David Nelson et al., filed on May 31, 2012, now U.S. Pat. No. 9,283,455, which claims the benefit of priority of U.S. Provisional Application Ser. No. 61/492,010, filed on Jun. 1, 2011. This application also claims the benefit of priority of U.S. Provisional Application Ser. No. 62/377,267, filed on Aug. 19, 2016. The contents of Ser. Nos. 13/485,775, 15/068,354, 61/492,010, and 62/377,267, including their drawings, schematics, diagrams, and written description, are hereby incorporated in their entirety by reference.

BACKGROUND

Field

This disclosure relates to a ball net structure adapted to be used in sports-related activities. More specifically, the disclosure is directed to a customizable ball net structure that is configured to be collapsible to allow for ease of portability, transport and assembly.

Description of the Related Art

Various sports such as soccer or baseball involve hitting or throwing projectiles such as soccer balls or baseballs toward a desired direction in a field. For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground.

A disadvantage of such structures is that they cannot be easily collapsed and efficiently stored. This is because both the support frame and the capturing frame must be properly folded and placed in a container. Further use of a capturing frame and a supporting frame makes such structures more expensive to manufacture and harder to carry due to increased weight.

There are portable ball net structures available, and they tend to have members that are formed of a single continuous piece or formed from numerous smaller pieces. A disadvantage of nets formed of a single continuous piece is that they cannot be easily collapsed and efficiently stored due in part to its size. For example, a portable soccer goal can be formed of a single continuous frame wherein wheels are attached to a base to allow the soccer goal to be transported or wheeled out to a desired location. Although portable, transporting or positioning the soccer goal can be cumbersome, especially if the soccer goal is a regulation sized goal.

Portable goals formed of numerous pieces are more likely to be collapsible and easy transport, but have the distinct disadvantage of being difficult and slow to set up, and not made of robust materials. For instance, loose fasteners may require tools for driving or tightening, and may also become lost in transit or storage or during assembly of the goal on the playing surface. Additionally, collapsible goals or nets may have components that are attached using lockable hinges. The hinges on such goals or nets typically require a locking device to hold the frame of the goal or net in a stable and locked position. Operation of the locking device of a typical hinge normally requires a person to press a button or release/attach a clip to collapse or deploy the goal or net. Pressing the button or releasing/attaching the clip could cause injury to a person, even if performed with care. Furthermore, the locking device can malfunction or break due to repeated strikes from a ball, bat, kicks from users while using the net, and the like. As such, the locking device would be inoperable and would not be able to lock the components at the hinge, such that the hinge would be ineffective at holding the support frame of the goal; thereby rendering the goal inoperable.

The above frame structures are typically configured for a single configuration and net, such that the frame is fixed and cannot be configured into a different arrangement for a different net and/or a different sports-related activity. For example, the portable soccer goal formed of a single continuous frame cannot be modified into a differently configured frame for a different net because the single continuous frame is permanently fixed and only designed to be used with a soccer goal net. In addition, frames formed of multiple pieces can only be assembled in the designed single configuration and is not customizable.

The disclosure is a ball net structure that is portable, collapsible, and able to be configured into different arrangements for different nets and/or different sports-related activities. For example, the ball net structure is can be configured to receive nets of different sizes and that are designed for different sports-related activities. The ball net structure is further configured to withstand forces applied to the ball net structure in order to improve the stability and/or durability of the ball net structure. The disclosure addresses these needs and provides further related advantages.

SUMMARY

The disclosure disclosed herein provides various aspects of a ball net structure that are cost effective, easy to assemble/disassemble, easily transportable and provide the required structural support to receive or capture a projectile such as but not limited to a soccer ball or baseball. The different aspects comprise elements to allow the ball net structure to be configured into a different arrangement, such that the structure can be used with a different net and/or a different sports-related activity. The ball net structure is configured to be collapsible, easy to transport between locations and yet provide a sufficiently sized net to allow for sports practice or training, such as but not limited to soccer or baseball. The disclosure is also configured such that the ball net structure can be easily assembled or disassembled by a single individual.

In one aspect, as broadly described herein, a ball net structure comprises a base structure including at least one support portion, at least one base extension, and a hinge, wherein the at least one support portion is coupled to the at least one base extension and the hinge. At least one rod is removably coupled to the base structure and received by a net, wherein the net is adapted to exert a pulling force on the at least one rod causing the at least one rod to exert a torque force onto said hinge in order to lock the at least one support portion in place.

In another aspect, the ball net structure comprises a base structure including first and second support portions pivotally attached to a hinge, a plurality of rods coupled to the base structure, and a net received by the plurality of rods, wherein the rods are configured to exert a force on the hinge in order to prevent rotation of the first and second support portions. The base structure, rods and net, when fully deployed, are adapted to withstand the force of a ball or projectile so as to capture the ball and to maintain the ball net structure in an upright position.

In another aspect, as broadly described herein, a ball net structure comprises a base structure comprising a first support portion, a first base extension, and a first base extension hinge, wherein the first support portion and the first base extension are coupled to the first base extension hinge. The base structure further comprising a second support portion, a second base extension, and a second base extension hinge, wherein the second support portion and the second base extension are coupled to the second base extension hinge. The first base extension is configured to engage an internal locking mechanism within the first base extension hinge in order to lock the first base extension within the first base extension hinge when the first base extension is fully deployed in an open position. The first base extension is configured to engage another internal locking mechanism within the first base extension hinge in order to lock the first base extension within the first base extension hinge when the first base extension is retracted in a closed position. The first support portion and the second support portion are pivotally coupled to a base hinge of the base structure, such that the first support portion and the second support portion are opposite each other. At least one rod is removably coupled to the base structure and is received by a net. The net is adapted to exert a pulling force on the at least one rod such that the at least one rod is in a flexed state.

In another aspect, a ball net support structure comprises a support portion comprising a first end and a second end, a first base extension hinge coupled to the first end of the support portion, a first base extension leg coupled to the first base extension hinge, such that the first base extension leg pivots about a first pivot point at a first position of the first base extension hinge and configured to engage a locking mechanism at a second position of the first base extension hinge, a second base extension hinge coupled to the second end of the support portion, a second base extension leg coupled to the second base extension hinge, such that the second base extension leg pivots about a second pivot point at a third position of the second base extension hinge and configured to engage locking mechanism at a fourth position of the second base extension hinge. A plurality of rods removably coupled to the ball net support structure and configured to receive a net.

This has outlined, rather broadly, the features and technical advantages of the disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIG. 2*c* is a side view of the hinge of the ball net structure of FIG. 1.

FIG. 3 is a partial perspective view of one aspect of a base structure of a ball net structure according to the disclosure.

FIG. 16 is a perspective view of a base extension bracket according to an aspect of the disclosure.

FIG. 17 is another perspective view of a base extension bracket according to an aspect of the disclosure.

DETAILED DESCRIPTION

Figure 1:
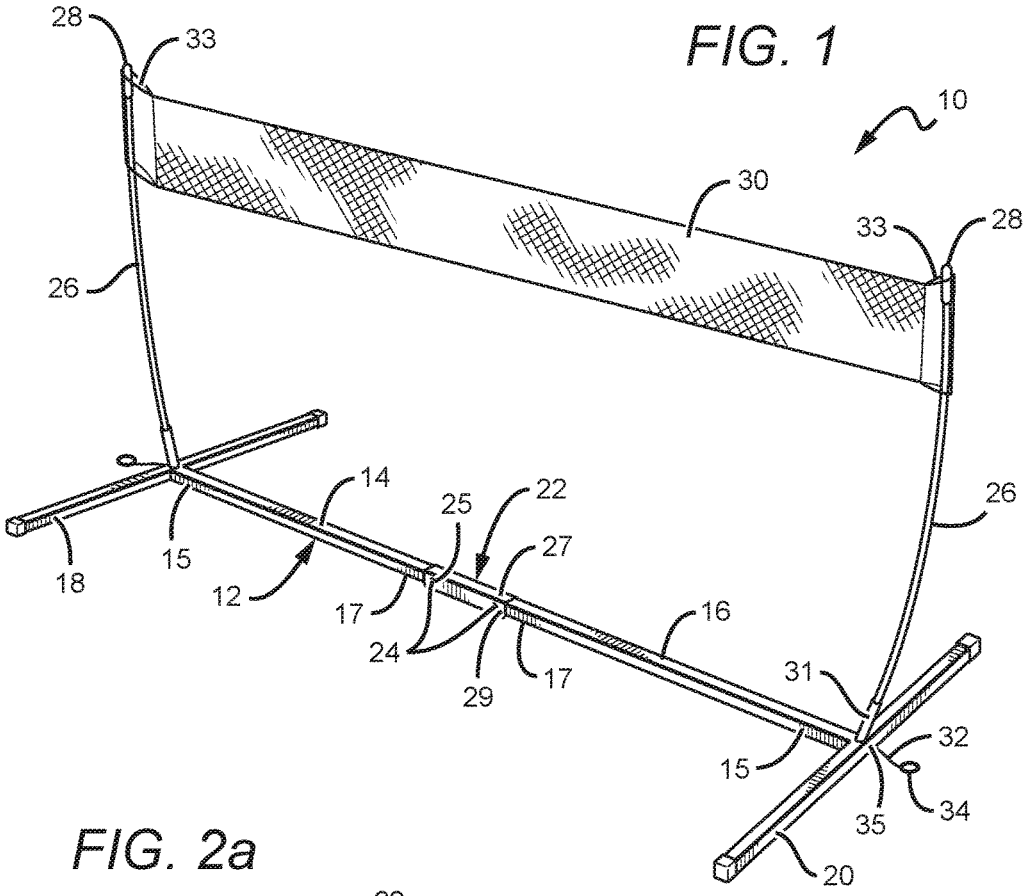
FIG. 1 is a perspective view of a ball net structure according to an aspect of the disclosure.

The disclosure described herein is directed to different aspects of a ball net structure that in some aspects provide a frame structure that is easy to setup and is collapsible such that the frame structure is easy to assemble and disassemble by a single individual, store, is portable, and is customizable for different nets and/or sports-related activities. The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The ball net structure can comprise many different materials and can be used in many different applications such as, but not limited to, practicing soccer skills, throwing and/or hitting baseballs. The ball net structure according to the disclosure can be arranged in many different ways with many different components, and is generally arranged to provide a net structure to capture or catch a projectile. In one aspect, as broadly described herein, a ball net structure comprises a base structure comprising at least one support portion and at least one base extension. The ball net structure further comprises a hinge, wherein the at least one support portion is coupled to the at least one base extension and the hinge. At least one rod is removably coupled to the base structure and is adapted to be received by a net. The net is adapted to exert a pulling force on the at least one rod causing the at least one rod to exert a torque force onto said hinge, whereby the at least one support portion is locked into place. In other aspects, the ball net structure comprises a base structure comprising a first support portion and a second support portion, wherein the first and second support portions are coupled to a hinge, such that the first and second support portions are opposite each other and the hinge is interposed therebetween. At least one rod is removably received by the base structure, wherein a net is adapted to receive the at least one rod. The ball net structure further comprises a first base extension coupled to the first support portion and a second base extension coupled to the second support portion. The first and second base extensions are adapted to further support the load of the ball net structure and allow the ball net structure to remain upright while in use. In some aspects, the ball net structure can also comprise an attachment device proximate the base structure, such that the attachment device is adapted to receive an attachment cord that is adapted to receive a weighted device or force resistance device to provide additional structural support. The attachment device can also be configured to receive part of the net. In some aspects, the attachment device can be on at least one base extension, at least one support portion, the hinge, or a combination thereof. At least one advantage of the ball net structure is that the ball net structure is configured to exert a force on the hinge so as to maintain the ball net structure in an upright state when deployed. This arrangement allows the hinge to remain in a fixed state without the need of one or more locking devices to lock the support portion to the hinge.

In another aspect of the disclosure, a ball net structure comprises a base structure comprising a first support portion, a first base extension, and a first base extension hinge, wherein the first support portion and the first base extension are coupled to the first base extension hinge. The base structure further comprising a second support portion, a second base extension, and a second base extension hinge, wherein the second support portion and the second base extension are coupled to the second base extension hinge. The first base extension is configured to engage an internal locking mechanism within the first base extension hinge in order to lock the first base extension within the first base extension hinge when the first base extension is fully deployed in an open position. The first base extension is further configured to engage another internal locking mechanism within the first base extension hinge in order to lock the first base extension within the first base extension hinge when the first base extension is retracted in a closed position. The first support portion and the second support portion are pivotally coupled to a base hinge of the base structure, such that the first support portion and the second support portion are opposite each other. At least one rod is removably coupled to the base structure and is received by a net. The net is adapted to exert a pulling force on the at least one rod such that the at least one rod is in a flexed state. The at least one rod configured to exert a torque force onto the base hinge in order to lock the first and second support portions.

In another aspect, a ball net support structure comprises a support portion comprising a first end and a second end, a first base extension hinge coupled to the first end of the support portion, a first base extension leg coupled to the first base extension hinge such that the first base extension leg pivots about a first pivot point at a first position of the first base extension hinge. The first base extension leg can be configured to engage a locking mechanism at a second position of the first base extension hinge. The ball net support structure can further comprise a second base extension hinge coupled to the second end of the support portion, a second base extension leg coupled to the second base extension hinge, such that the second base extension leg pivots about a second pivot point at a third position of the second base extension hinge. The second base extension leg can be configured to engage a locking mechanism at a fourth position of the second base extension hinge. The ball net support structure further comprising a plurality of rods removably coupled to the ball net support structure and configured to receive a net.

The ball net structure of the disclosure can provide a number of additional advantages beyond those mentioned above. For example, the hinge allows for ease of assembly/disassembly and storage of the ball net structure because the hinge does not have a locking device that needs to be forcibly engaged and/or disengaged. Typical hinges have a locking pin that prevents an element from pivoting about a hinge. These locking pins can be hard to engage and/or disengage which could cause injury to the person trying to engage and/or disengage the locking pin. Other typical hinges have a locking button, instead of a locking pin, that is depressed in order to allow an element to be engaged and/or disengaged from the hinge. In such hinges, operation of the locking button requires the person to press down and pivot the element about the hinge. In some instances, the person pressing the locking button could get a portion of their finger caught and/or pinched by the button causing injury. In addition, these locking buttons/pins may not withstand forces imparted by a ball, projectile, bat, and/or forces from users, such as kicks, that occur during use. Another advantage of the disclosure is that the ball net structure is collapsible such that the ball net structure can be folded upon itself and form a smaller package that can easily be transported and/or stored without taking up too much physical space. A disadvantage of typical hinges having the locking pin or the locking button is that the locking pin or the locking button will deteriorate over time due to many different factors, such as the load imparted onto them or by damage due to repeated use or misuse. At least another advantage of the disclosure is that the base extension hinge is configured to withstand the forces imparted by a ball, projectile, bat, and/or forces from users, such as kicks, that occur during use and/or while disassembled and stored, in order to improve the durability and/or stability of the ball net structure.

The ball net structure of the disclosure can be used to stop or capture a ball or the like when performing sports-related activities. However, the disclosure is not intended to be limited to such aspects. As further described below, the ball net structure can be arranged to allow an individual to easily deploy and disassemble the ball net structure in an outdoor or indoor setting. In addition, the ball net structure can be used as a barrier or safety net to protect spectators and/or other people that may be on a practice field.

The disclosure is described herein with reference to certain aspects, but it is understood that the disclosure can be embodied in many different forms and should not be construed as limited to the aspects set forth herein. In particular, the disclosure is described below in regards to a ball net structure to practice or perform sports-related activities in an outdoor setting, but it is understood that the disclosure can be used for many other applications in many different settings. The components of the ball net structure can have different shapes and sizes beyond those shown in the figures or discussed herein.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the disclosure can be arranged in many different ways with many more features and elements beyond what is shown in the figures.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Aspects of the disclosure are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the disclosure.

Figure 2A:
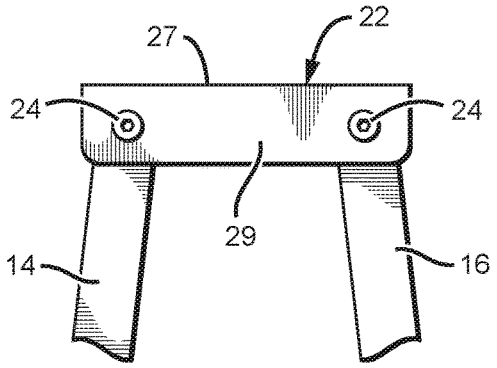
FIG. 2*a* is a side view of a hinge of the ball net structure of FIG. 1.
Figure 2B:
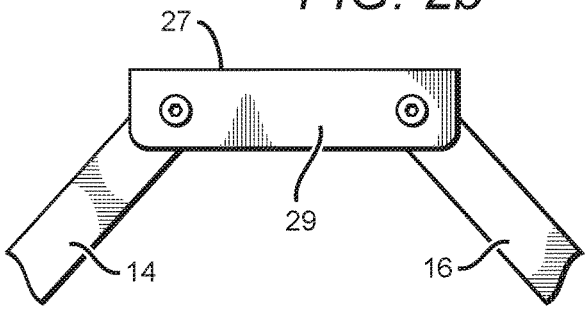
FIG. 2*b* is a side view of the hinge of the ball net structure of FIG. 1.

FIGS. 1-2*c* show one aspect of a ball net structure 10 according to an aspect of the disclosure. In some aspects, the ball net structure 10 is configured such that the ball net structure 10 can be deployed in an outdoor setting such as, but not limited to, a natural grass, synthetic field, dirt, concrete or the like. In other aspects, the ball net structure 10 can be deployed in an indoor setting such as but not limited to an indoor training facility, residential or commercial setting having a synthetic or natural surface, or the like. The ball net structure 10 can then be used in sports-related activities, such as but not limited to baseball, softball, soccer, football and the like. The ball net structure 10 can also be used to allow users to practice kicking, hitting or throwing a ball or other projectile to the ball net structure 10, such that the ball net structure captures or catches the ball so that the user does not have to travel great distances to retrieve the ball. The ball net structure 10 comprises a base structure 12 including first and second support portions 14, 16 pivotally attached to a hinge 22, a plurality of rods 26 removably coupled to the base structure 12, and a net 30 adapted to receive the plurality of rods 26. The aspect shown in FIG. 1 has two rods 26, but other aspects can have more than two rods 26. The rods 26 are configured to exert a force on the hinge 22 in order to lock the first and second support portions 14, 16 in place and prevent rotation of the first and second portions 14, 16 about the hinge 22. The base structure 12, rods 26 and net 30, when fully assembled and deployed, are adapted to withstand the force of a ball or projectile so as to capture the ball while keeping the ball net structure 10 in an upright position.

For the same or similar elements or features, the reference numbers from FIGS. 1-2*c* will be used throughout the application herein. In one aspect of the disclosure, the base structure 12 can further comprise a first base extension 18 coupled to the first support portion 14 and a second base extension 20 coupled to the second support portion 16. This arrangement allows the first and second base extensions 18, 20 to provide additional structural support to further stabilize the ball net structure 10 in an upright position. In some aspects, the first and second base extensions 18, 20 can be coupled to the respective support portions 14, 16 such that the first and second base extensions 18, 20 are perpendicular to the respective support portion 14, 16. In other aspects, the first and second base extensions 18, 20 can be angled in a V-shaped configuration and configured to raise the base structure 12 above the ground or surface or allow the base structure 12 to contact the ground or surface, wherein the angle of the V-shaped base extensions 18, 20 can be in the range of 90°-140° (degrees). In yet other aspects, as in FIG. 3, a base extension 55 comprises a base extension hinge 50 coupled to the support portions 16 and 14 (not shown), first and second base extension legs 52, 54 pivotally attached to the base extension hinge 50 about a respective pivot point 51, and can be locked into place by respective locking pins/buttons 53. In this arrangement, the legs 52, 54 can be released from their respective locking pins/buttons 53 and are able to rotate about pivot points 51 towards the support portions 16 and 14 such that the base structure 56 is further collapsible and easy to transport. In the aspect of FIG. 1, the base extensions 18, 20 are stationary and are not able to be rotated towards their respective support portion 14, 16. Additionally, the first and second legs 52, 54, in FIG. 3, are arranged, either bent, curved, or straight, such that the base structure 56 is elevated off the ground or surface. However, in other aspects, the legs 52, 54 can be arranged to allow the base structure 56 to contact the ground or surface. The legs 52, 54 can also comprise the attachment device 35, attachment cord 32 and ring 34 as discussed in the aspect of FIG. 1.

The first and second support portions 14, 16 each have a first end 15 and a second end 17, wherein the first end 15 of each of the support portions 14, 16 is coupled to the respective base extensions 18, 20. The first and second support portions 14, 16 extend from the respective base extensions 18, 20 towards a hinge 22 and are pivotally coupled to the hinge 22, such that the base extensions 18, 20 are opposite the hinge 22. The second ends 17 of support portions 14, 16 are coupled to the hinge 22 using hinge pins 24. The hinge 22 has openings 25 that receive the hinge pins 24 so as to couple the support portions 14, 16 to the hinge 22. In one aspect, the hinge pins 24 can be screws with a nut to hold the screw in place. However, in other aspects, the openings 25 of the hinge 22 can be threaded to receive the hinge pins 24, or the hinge pins can be nails, rivets or the like. The support portions 14, 16 can be coupled to the hinge 22 using various known means in the art and is not intended to be limited to the aspects disclosed herein. The first and second support portions 14, 16 can be made of many different materials, such as but not limited to wood, plastic, metal, a composition thereof or the like. The first and second support portions 14, 16 can be formed to have many different shapes, such as but not limited to circular, square, polygonal, a combination thereof or the like. The first and second portions 14, 16 of the aspect of FIGS. 1-2*c* are shown as having a square-like shape.

The hinge 22 is arranged to receive at least a portion of the first and second support portions 14, 16 such that the support portions 14, 16 are able to rotate about the respective hinge pin 24. In one aspect, the hinge 22 is configured to be a U-shaped channel having a hinge base 27, sidewalls 29 and openings 25 to allow respective hinge pins 24 to be received by the hinge 22 as well as the first and second support portions 14, 16, such that the first and second support portions 14, 16 are pivotally coupled to hinge 22. In the aspect of FIG. 1, the second ends 17 of each of the first and second support portions 14, 16 are pivotally coupled to the hinge 22. However, in other aspects, the first and second support portions 14, 16 can be pivotally coupled to the hinge 22 at different locations between the first and second ends 15, 17.

An advantage of the disclosure is that in some aspects the hinge 22 can be U-shaped which allows the hinge 22 to hold the first and second support portions 14, 16 in a stable and parallel position along the same axis and also provides a physical stop which prevents the first and second support portions 14, 16 from pivoting beyond the physical stop. However, in other aspects, the hinge 22 can be shaped in different forms such that the support portions 14, 16 are not aligned along the same axis, can be parallel or non-parallel, yet still provide a physical stop to prevent the portions 14, 16 from rotating beyond the physical stop.

As shown in FIGS. 1-2*c*, the first and second portions 14, 16 are coupled to the hinge 22, using hinge pins 24, such that they rotate about the respective hinge pin 24. Rotation of the first support portion 14, in a direction opposite the second support portion 16, about the hinge pin 24 will stop when the first support portion 14 comes into contact with the hinge base of the hinge 22; FIG. 2*c* shows an example of the support portions 14, 16 in contact with the hinge base 27 and precluding further rotation. The hinge base 27 provides a physical stop and prevents the first support portion 14 from further rotation. The second support portion 16 is similarly configured as the first support portion 14 and will stop rotating about hinge pin 24 when the second support portion 16 contacts the hinge base 27. The physical stop provided by the hinge 22 properly aligns the first and second support portions 14, 16 when assembling the ball net structure 10. Yet another advantage of the disclosure is that the hinge 22 allows the base structure 12 to be folded onto itself so that the ball net structure 10 can be easily stored as well as easy to transport. This arrangement allows the base structure 12 to reduce its size and/or area, thereby allowing the ball net structure 10 to be stored in a small container.

When assembling the ball net structure 10, the first and second support portions 14, 16 of the base structure 12 are rotated away from the opposite support portion 16, 14 towards the hinge base 27. When the support portions 14, 16 are in contact with the hinge base 27, precluding further rotation, the base structure 12 is ready to be placed on the playing surface, such as but not limited to a natural grass, synthetic filed, cement, wood, asphalt, or the like. The base structure 12 is placed on the playing surface such that the hinge base 27 is opposite the playing surface. In other words, the hinge base 27 does not contact the surface upon which the base structure 12 is positioned on. At this point, the at least one rod 26 is ready to be installed.

The base structure 12 is further adapted to receive the at least one rod 26. In one aspect, the base structure 12 comprises at least one shaft 31 extending substantially vertically and configured to receive one of the at least one rod 26. In another aspect, the base structure 12 comprises a plurality of shafts 31, wherein each respective shaft 31 is adapted to receive a respective one of the at least one rod 26. In the aspect of FIG. 1, the base structure 12 comprises two shafts 31, with one shaft 31 coupled to the first base extension 18 and another shaft 31 coupled to the second base extension 20. As shown in FIG. 1, each of the shafts 31 are coupled to a respective base extension 18, 20 proximate the first end 15 of the first and second support portions 14, 16. However, in other aspects, the shaft 31 can be positioned at various other locations on the base extensions 18, 20 and/or the support portions 14, 16, or a combination thereof. In yet other aspects, the base structure 12 can comprise more than two shafts 31 for aspects that comprise more than two rods 26. The number of shafts 31 present will be equal to the number of rods 26.

The at least one rods 26 are configured to be securely held within the shaft 31, such that the shaft 31 maintains a stable structural connection between the shaft 31 and the at least one rods 26 and prevents the rod 26 from being removed from the shaft 31 when the ball net structure 10 is assembled. In one aspect of the disclosure, the shaft 31 is similarly shaped as the rod 26, such as but not limited to cylindrically shaped, and is slightly larger than the rod 26 such that the rod 26 can easily be received by the shaft 31. The shaft 31 can further comprise a sheath contacting the inner wall of the shaft 31 that receives the rod 26. The sheath is adapted to protect the rod 26 within the shaft 31 from forces exerted on the rod 26 when the ball net structure 10 is fully assembled. As will be discussed below, upon assembly of the ball net structure 10, the rods 26 experience a moment force at the point where the rod 26 is received by the shaft 31, and causes the rod 26 to exert a compression force upon the sheath. The sheath thereby protects the rod 26 from the forces exerted on and/or by the rod 26.

In other aspects, the shaft 31 can be shaped such that the radius of the shaft 31 decreases the further the rod 26 is inserted into the shaft 31. In this arrangement, the shaft 31 uses a compression force to form the structural connection between the shaft 31 and the rod 26. In other aspects, mechanical devices, such as but not limited to, screws, nuts, nails, rivets or the like, can be used to form the structural connection so as to securely attach the rod 26 to the shaft 31. In yet other aspects, the rods 26 can be configured to have an attachment means such that the rods 26 can be attached to the shaft 31; non-limiting examples of such attachment means are the rods 26 being threaded and screwed into the shaft 31 or the rod 26 and shaft 31 configured similarly like a bayonet-type locking device.

In the aspect of FIG. 1, the rods 26 are circularly shaped and the shaft 31 is also correspondingly circularly shaped to receive the rod 26. The shape of the rod 26 and shaft is not intended to be limited to a circular shape, other shapes such as quadrilateral, triangular, or any other polygonal shape can be used. The shaft 31 can also be similarly shaped as the rod 26, but in some aspects, the shaft 31 can be shaped differently than the rod 26. The rods 26 can be made of many different materials known in the art, such as but not limited to fiberglass or carbon fiber, such that the rods 26 are flexible, elastic, capable of returning to an initial form or state after deformation, and able to withstand the impact forces applied by sports-related balls and/or other projectiles that can be captured or caught by the ball net structure 10, or thrown, kicked, and/or hit towards the ball net structure 10.

The rods 26, when received by the shaft 31 flare outwards in a direction opposite the hinge 22, such that the rods 26 are in a relaxed state and are substantially straight. A net 30 comprising at least one sleeve 33 is arranged to receive the at least one rod 26 and is adapted to exert a force on the at least one rod 26 bending the at least one rod 26 into a flexed state. Inserting the at least one rod 26 into the sleeve 33 requires that the at least one rod 26 be bent from the relaxed state into a flexed state to allow the sleeve 33 to receive the at least one rod 26. As shown in the aspect of the disclosure in FIG. 1, when both rods 26 are received by the respective shaft 31 and the net 30, both rods 26 are bent in a direction towards the hinge 22 and into the flexed state. Removal of the net 30 allows the rods 26 to return to their original form of the relaxed state. Repeated use of the ball net structure 10 does not result in the rods 26 being permanently bent in a shape similar to that of the flexed state. The net 30 can be easily installed and removed by a single individual.

The net 30 imparts a pulling force on each of the rods which causes each of the rods 26 to bend in a direction towards the hinge 22. Once bent towards the hinge 22, the rods 26 are in the flexed state and experience a moment force about its pivot point. The pivot point of each of the rods 26 corresponds to the point at which the rods 26 are received by the shaft 31. The moment force experienced by the rods 26 is imparted onto the hinge 22 and the first and second support portions 14, 16 of the base structure 12, with the transferred force being greatest at the hinge 22. This transferred force further assists in locking the hinge 22 and base structure 12, such that the first and second support portions 14, 16 are locked into place.

An advantage of the disclosure is that the force exerted onto the rods 26 by the net 30 results in a torque force experienced by the rods 26 and transferred to the hinge 22, which allows the hinge 22 to lock the first and second support portions 14, 16 into place without the need of a locking device such as a locking clip or button. The absence of such a locking device on the hinge 22 prolongs the lifetime of the ball net structure 10 due, in part, to the hinge 22 not deteriorating or breaking down due to failure or malfunctioning of the locking clip or button.

Figure 4:
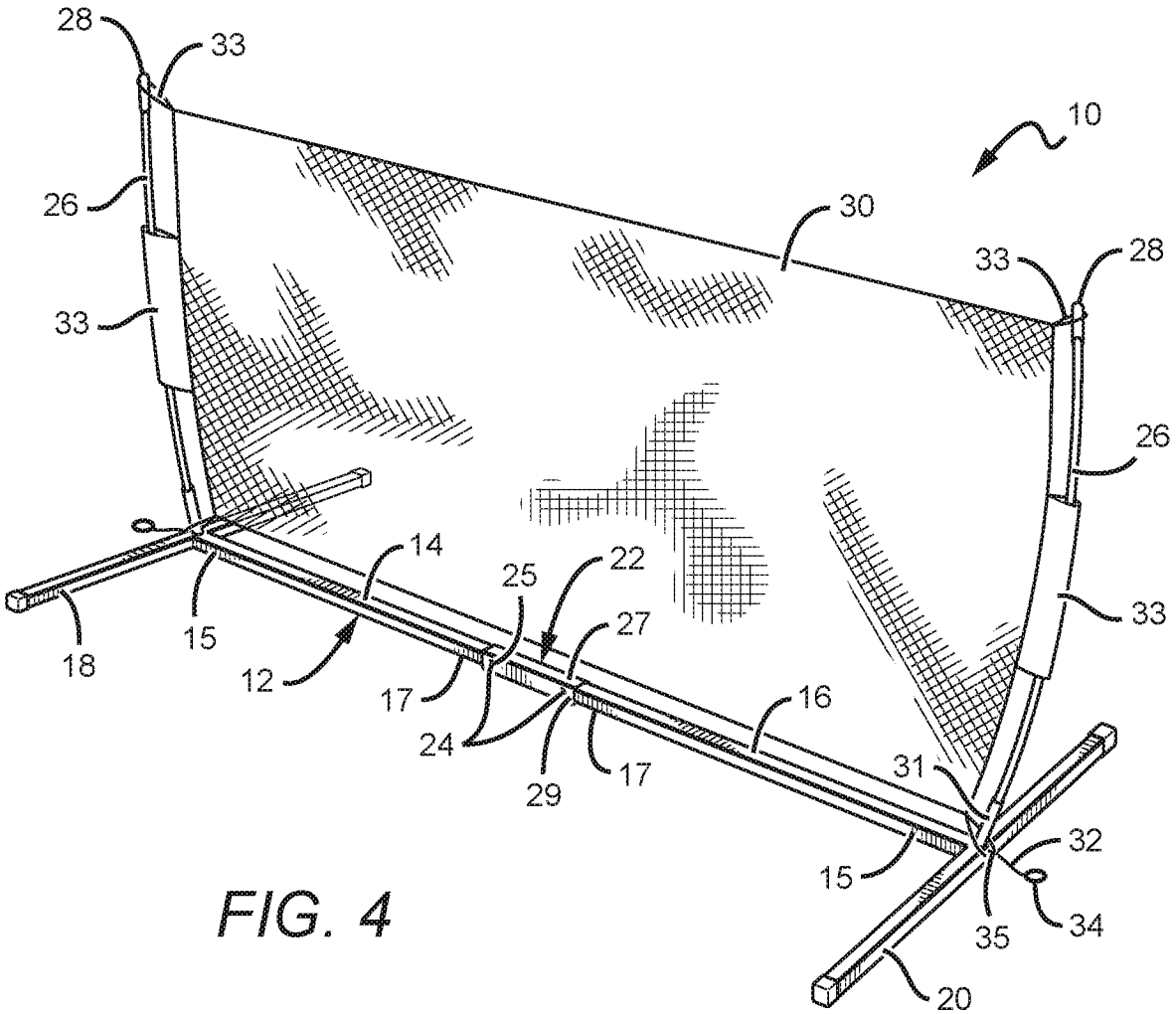
FIG. 4 is a perspective view of another aspect of a ball net structure according to the disclosure.

The net 30 can be a mesh surface or any typical net known in the art. The net comprises at least one sleeve 33 adapted to receive the rod 26 so at to mount the net 30 onto the rods 26. The aspect of FIG. 1 shows the net 30 having a sleeve 33 in the form of a plurality of loops that receive the rods 26. However, in other aspects, such as FIG. 4, the net 30 comprises a plurality of sleeves 33 wherein at least one of the plurality of sleeves 33 receives the base structure 12, in order to provide additional structural support for the ball net structure 10. The sleeve 33 can be configured in many different ways, such as but not limited to a sleeve that spans the length of the rod, a plurality of smaller sleeves that are spaced apart from each other and run along the length of the rods 26, or a sleeve that spans along a partial length of the rods 26. In some aspects, each rod 26 comprises an endcap 28 opposite the portion of the rod 26 that is received by the shaft 31 and is configured to receive at least a portion of the sleeve 33, such that the endcap 28 prevents the sleeve 33 from coming off the rods 26 while the ball net structure 10 is assembled and/or in use. In one aspect, the endcaps 28 can have a tab that extends outward beyond the external shape of the rod 26 that prevents the net 30 from coming off the rod 26. However, in other aspects, the endcaps 28 can have other means of preventing the net 30 from coming off the rod 26, such as but not limited to a hook, loop, locking clip, or the like.

The ball net structure 10 according to the disclosure is designed to withstand the force of a ball or other projectile so as to catch or capture the ball, such that the ball net structure 10 maintains an upright standing position. In some aspects of the disclosure, the ball net structure 10 can comprise at least one attachment device 35 that can receive an attachment cord 32 having a ring 34. The attachment cord 32 allows for the connection of a weight, stake or similar device to provide additional support for the ball net structure 10. In the aspect of FIG. 1, the attachment device 35 is a loop-like device that is coupled to the base structure 10 and allows the attachment cord 32 to be tied or coupled to the attachment device 35. The attachment cord 32 can be a bungee cord, rope, or the like. The ring 34 allows for a weighted or force-resistant device (not shown), such as but not limited to a sandbag or a suction cup, to be attached to the base structure 12 to provide additional support for the ball net structure 10 and prevent the ball net structure 10 from moving, falling over, or shifting. The ring 34 can also be used to receive a stake, staple, hook or similar device that is inserted into the ground or surface so as to attach the ball net structure 10 to the ground or surface.

The attachment device 35 is configured to extend laterally or horizontally from the base structure 12, such that the weight or similar device attached to the cord 32 provides a lateral support, which prevents the ball net structure 10 from lifting upwards or shifting its position. In some aspects, the net 30 can be received by the attachment device 35, such that the sleeve 33 of the net 30 is coupled to the attachment device 35. The attachment device 35 allows for both the sleeve 33 and the cord 32 to be coupled to the attachment device 35. An advantage of this arrangement is that the weight or similar device attached to the attachment device 35 can also act as a shock absorber when a ball or projectile is caught or captured by the ball net structure 10. The force of the ball is distributed throughout the ball net structure 10 and also partially transferred to the weight or device attached to the attachment device 35, which further provides additional support to the ball net structure 10 which increases the stability and/or the force the ball net structure 10 can withstand. In other aspects of the disclosure, the ball net structure 10 comprises a plurality of attachment devices 35 and can be disposed on the base structure 12 and/or on base extensions 18, 20.

Figure 5:
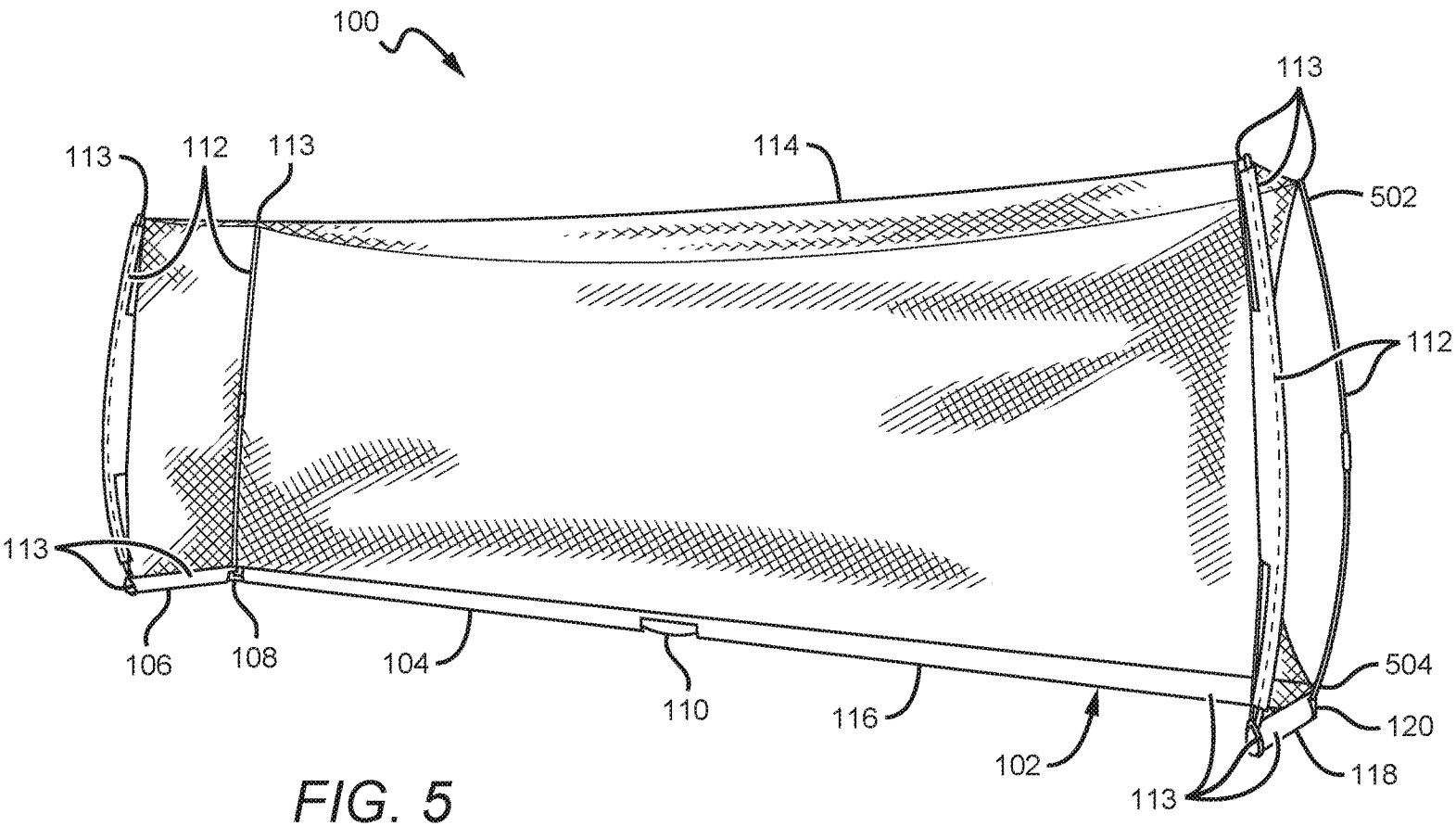
FIG. 5 is a perspective view of a ball net structure according to an aspect of the disclosure.

FIG. 5 shows one aspect of a ball net structure 100 according to the disclosure.

The ball net structure 100 comprises a base structure 102 comprising at least one support portion 104, at least one base extension 106, at least one base extension hinge 108, and a base hinge 110, wherein the at least one support portion 104 is coupled to the at least one base extension hinge 108 and the base hinge 110, such that the at least one base extension hinge 108 is opposite the base hinge 110. The at least one base extension 106 is pivotally coupled to the at least one base extension hinge 108. At least one flexible rod 112 is removably coupled to the base structure 102 and is received by a net 114, wherein the net 114 is adapted to exert a pulling force on the at least one flexible rod 112 such that the at least one flexible rod 112 is in a flexed state. The at least one flexible rod 112 in the flexed state exerts a force onto said base hinge 110 in order to lock the at least one support portion 104 in place.

In the aspect of FIG. 5, the base structure 102 comprises a first support portion 104, a first base extension 106, and a first base extension hinge 108. The base structure 102 further comprises a second support portion 116, a second base extension 118, and a second base extension hinge 120. The first support portion 104 is coupled to the first base extension hinge 108 and the base hinge 110. The second support portion 116 is coupled to the second base extension hinge 120 and the base hinge 110. The first base extension 106 is coupled to the first base extension hinge 108, wherein the first base extension 106 pivots about a pivot point of the first base extension hinge 108. The second base extension 118 is coupled to the second base extension hinge 120, wherein the second base extension 118 pivots about a pivot point of the second base extension hinge 120. The first and second base extensions 106, 118 are configured to pivot along a first plane. A plurality of flexible rods 112 are removably coupled to the base structure 102, wherein each flexible rod 112 comprises an upper end 502 and a lower end 504. The lower end 504 of each flexible rod 112 is removably coupled to the base structure 102. A net 114 is received by at least one of the plurality of flexible rods 112 and at least part of the base structure 102. In the aspect of FIG. 5, each flexible rod 112 is configured to receive at least part of the net 114. The net 114 is configured to be received by at least the upper ends 502 of the plurality of flexible rods 112. The net 114 can be configured to receive at least part of at least one flexible rod 112 between the upper end 502 and the lower end 504. In some aspects, the net 114 can receive substantially all of at least one flexible rod 112 between the upper end 502 and the lower end 504. The net 114 received by the plurality of rods 112 comprises a back wall, two side walls, and a top wall. The net 114 can also be received by the base structure 102. In the aspect of FIG. 5, the net is received by the first and second base extensions 106, 118 and the first and second support portions 104, 116 which assist in maintaining the shape of the net. The net 114 is adapted to exert a pulling force on the plurality of flexible rods 112 such that the rods are bent from a linear state to an arcuate state. In the aspect of FIG. 5, the flexible rods 112 are removably coupled to the first and second base extension hinges 108, 120 and at ends of the first and second base extensions 106, 118 opposite the first and second base extension hinges. In some aspects the rods can be removably coupled at different locations along the base structure 102 and the disclosure is not intended to be limited to the aspects disclosed herein. The net 114 is configured to bend the plurality of flexible rods from a relaxed linear state to an arcuate state or a bow shaped flexed state, wherein the plurality of flexible rods are biased away from at least one of the plurality of flexible rods to hold the net upright. The rods in the flexed state provide a force onto at least part of the base structure 102 to lock the first and second support portions 104, 116. The first and second support portions 104, 116 and the first and second base extensions 106, 118 are adapted to assist in supporting the load of the ball net structure 100 such that the ball net structure 100 remains upright. The first and second base extensions 106, 118 absorb at least part of the load exerted onto the ball net structure 100 from a ball or other projectile when in use so as to maintain the ball net structure 100 in an upright position.

The first and second support portions 104, 116 can be substantially similar. As such, a discussion of the first support portion 104 will be presented herein with the understanding that such disclosure can be applicable to the second support portion 116, in an effort to reduce duplicate descriptions. However, the disclosure does not require the first and second support portions to be identical. In some aspects, the first and/or second support portion 104, 116 can comprise some of the same elements disclosed herein. While in some aspects, the first and/or second support portions do not necessarily comprise some of the same elements of the other support portion(s). The first and second base extension hinges 108, 120 can be substantially similar and mirror images of each other. As such, a discussion of the first base extension hinge 108 will be presented herein with the understanding that such disclosure can be applicable to the second base extension hinge 120, in an effort to reduce duplicate descriptions. However, the disclosure does not require the first and second base extensions hinges to be identical. In some aspects, the first and/or second base extension hinges 108, 120 can comprise some of the same elements disclosed herein. While in some aspects, the first and/or second base extension hinges do not necessarily comprise some of the same elements of the other base extension hinge(s). The first and second base extensions 106, 118 can be substantially similar, and the following discussion referring to the first base extension 106 is understood to be applicable to the second base extension 118. However, the first and second base extensions do not have to be identical. In some aspects, the first and/or second base extensions 106, 118 can comprise some of the same elements disclosed herein. In some aspects, the first and/or second base extensions do not comprise some of the same elements of the other base extension(s).

Figure 6:
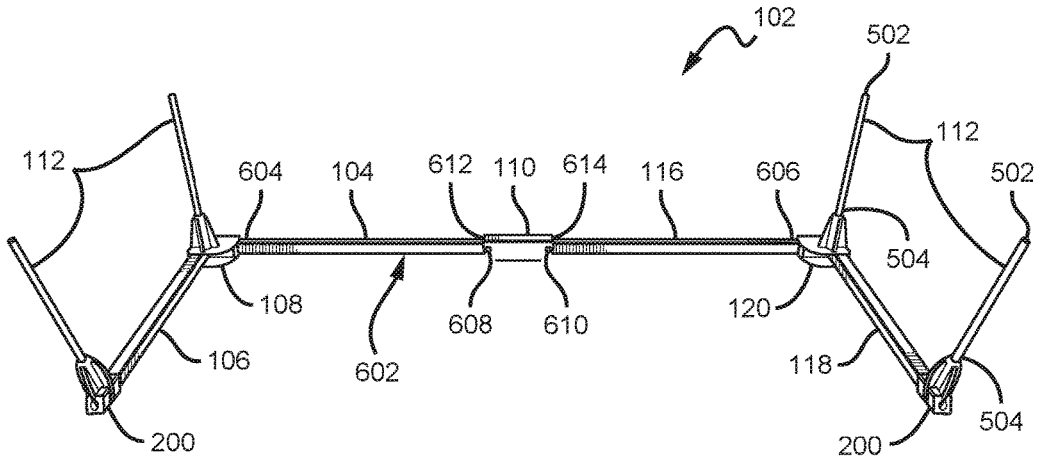
FIG. 6 is a perspective view of a base structure according to an aspect of the disclosure.

FIG. 6 shows one aspect of a base structure 102 according to the disclosure.

The base structure 102 comprises a support portion 602 comprising a first end 604 and a second end 606, and first and second base extensions 106, 118 coupled to the support portion 602. A first base extension hinge 108 is coupled to the first end 604 of the support portion 602 and configured to receive the first base extension 106, such that the first base extension 106 is pivotally coupled to the first base extension hinge 108. The first base extension hinge 108 pivotally couples the first base extension 106 to the support portion 602. The first end 604 of the support portion 602 is fixedly attached to the first base extension hinge 108. A second base extension hinge 120 is coupled to the second end 606 of the support portion 602 and configured to receive the second base extension 118, such that the second base extension 118 is pivotally coupled to the second base extension hinge 120. The second base extension hinge 120 pivotally couples the second base extension 118 to the support portion 602. The second end 606 of the support portion 602 is fixedly attached to the second base extension hinge 120. The first and second base extensions 106, 118 are adapted to pivot towards the support portion 602 and away from the support portion 602 along a first plane. The first base extension 106 is adapted to pivot within the first base extension hinge 108 to collapse and/or deploy the first base extension 106. To collapse the first base extension 106, the first base extension 106 is released from the first base extension hinge 108 and pivoted within the first base extension hinge 108 towards the support portion 602 such that the first base extension 106 is adjacent the support portion 602. Collapsing the first base extension 106 prepares the base structure 102 for storage when the ball net structure 100 is not in use. To deploy the first base extension 106, the first base extension 106 is pivoted within the first base extension hinge 108 away from the support portion 602 until the first base extension reaches an end of a pivot range. When the first base extension 106 reaches the end of the pivot range, the first base extension 106 is positioned to engage an internal locking mechanism within the first base extension hinge 108, wherein the first base extension 106 is inserted into the first base extension hinge 108 and engages the internal locking mechanism. The first base extension 106 is adapted to engage the internal locking mechanism in order to substantially lock the first base extension 106 within the first base extension hinge 108. The second base extension 118 and the second base extension hinge 120 are configured in a manner similar to the first base extension 106 and first base extension hinge 108, such that the second base extension 118 can be collapsed and/or deployed in a manner similar to the first base extension 106.

The support portion 602 extends longitudinally between the first end 604 and the second end 606. The support portion 602 can comprise a plurality of support portions and at least one intervening structure configured to receive at least two of the plurality of support portions. In the aspect of FIG. 6, the support portion 602 comprises a first support portion 104 and a second support portion 116, wherein the first support portion 104 is coupled to the first base extension hinge 108 and the second support portion 116 is coupled to the second base extension hinge 120. The at least one intervening structure of the support portion 602 can comprise a base hinge 110 adapted to receive the first support portion 104 and the second support portion 116, such that the first support portion 104 rotates about a first pivot 608 of the base hinge 110 and the second support portion 116 rotates about a second pivot 610 of the base hinge 110. The base hinge 110 can be configured in a manner similar to the hinge 22, discussed above. The first and second support portions 104, 116 are adapted to pivot towards and/or away from each other along a second plane. In the aspect of FIG. 6, the second plane is substantially perpendicular to the first plane of pivot motion of the first and second base extensions 106, 118. In some aspects, the second plane can be substantially parallel to the first plane. In some aspects, the first plane and second plane can intersect. In some aspects, at least one of the first plane or second plane is parallel to the surface that the ball net structure 100 is disposed on.

The first support portion 104 is coupled to the base hinge 110, such that the first base extension hinge 108 and the base hinge 110 are coupled to opposing ends of the first support portion 104. The first base extension hinge 108 is coupled to the first end 604 of the first support portion, and the first support portion 104 is coupled to the base hinge 110 at a third end 612. The second support portion 116 is coupled to the base hinge 110 opposite the first support portion 104, such that the second base extension hinge 120 and the base hinge 110 are coupled to opposing ends of the second support portion 116. The second base extension hinge 120 is coupled to the second end 606 of the second support portion 116, and the second support portion 116 is coupled to the base hinge 110 at a fourth end 614. In the aspect of FIG. 6, the first support portion 104 is fixedly attached to the first base extension hinge 108 and the first base extension 106 is adapted to pivot within the first base extension hinge 108 towards and/or away from the first support portion 104. To collapse the first base extension 106, the first base extension 106 is pivoted towards the first support portion 104 such that the first base extension is adjacent the first support portion. To deploy the first base extension, the first base extension is pivoted within the first base extension hinge away from the first support portion until the first base extension reaches the end of the pivot range, at which point the first base extension 106 can engage the internal locking mechanism within the first base extension hinge 108 to lock the first base extension. The first base extension 106 engages the internal locking mechanism by slidably inserting the first base extension into the first base extension hinge 108. The second base extension 118 is pivoted with respect to the second support portion 116 to deploy and/or collapse the second base extension 118 similarly as the first base extension 106. As such, when the second base extension is collapsed, the second base extension is adjacent the second support portion. When deployed, the second base extension is pivoted within the second base extension hinge 120 away from the second support portion 116 until the second base extension reaches an end of a pivot range. The second base extension 118 is thereby positioned to engage the internal locking mechanism within the second base extension hinge 120, wherein the second base extension is inserted into the second base extension hinge 120 and engages the internal locking mechanism within the second base extension hinge 120 to lock the second base extension.

The base structure 102 is configured to receive at least one flexible rod 112. In the aspect of FIG. 6, the base structure 102 receives a plurality of flexible rods 112, wherein each flexible rod 112 comprises an upper end 502 and a lower end 504, such that the lower end 504 is removably coupled to the base structure 102. A first flexible rod 112 is received by the first base extension hinge 108, a second flexible rod 112 is received by the second base extension hinge 120, a third flexible rod 112 is received by the first base extension 106, and a fourth flexible rod 112 is received by the second base extension 118. The base structure 102 can further comprise a base extension bracket 200 on the first and second base extensions 106, 118 to receive the respective flexible rods. A first base extension bracket 200 can be on an end 616 of the first base extension 106 opposite the first base extension hinge 108. A second base extension bracket 200 can be on an end 618 of the second base extension 118 opposite the second base extension hinge 120. In some aspects, the base extension bracket 200 can be anywhere on the base extension between the end and the base extension hinge, and is not intended to be limited to being on the end of the base extension. The base extension bracket 200 is configured to receive at least one rod 112. As shown in FIG. 6, the third rod 112 is received by the base extension bracket 200 on the end 616 of the first base extension 106, and the fourth rod 112 is received by the base extension bracket 200 on the end 618 of the second base extension 118. The flexible rods 112, as shown in FIG. 6, are in the relaxed state and are substantially straight. The rods 112 in the relaxed state flare outwards in a direction away from the base structure 102. A net 114 is arranged to be received by the first and second base extensions 106, 118, the support portion 602, and at least the upper end 502 of the at least one flexible rod 112. The net 114 is adapted to exert a force on the at least one flexible rod bending the at least one flexible rod into a flexed state, such that a net tension pulls the at least one flexible rod into the flexed state. In the aspects of FIGS. 5 and 6, the ball net structure 100 comprises four rods 112, and each of the four rods 112 is received by the net 114 such that the rods 112 are bent in a direction towards the base structure 102 and into the flexed state. However, the disclosure is not intended to be limited to the aspects disclosed herein. In some aspects, the ball net structure can comprise less than four rods, more than four rods, or any number of rods and is not intended to be limited to four rods. At least the upper end 502 of the flexible rods 112 are configured to receive the net 114, such that the net bends the rods from a relaxed linear state to an arcuate state or a bow shaped flexed state, such that the rods are biased away from at least one rod to hold the net upright. The net tension pulls at least the first rod into the arcuate state and the net tension simultaneously pulls the remaining rods into the arcuate state. The support portion 602 and the first and second base extensions 106, 118 support the load of the ball net structure 100 and allow it to remain upright on a surface. The first and second base extensions absorb at least part of a load exerted onto the ball net structure 100 from a ball or other projection when in use to stabilize the ball net structure on a surface.

FIGS. 7-15 show one aspect of a base extension hinge according to the disclosure.

Figure 7:
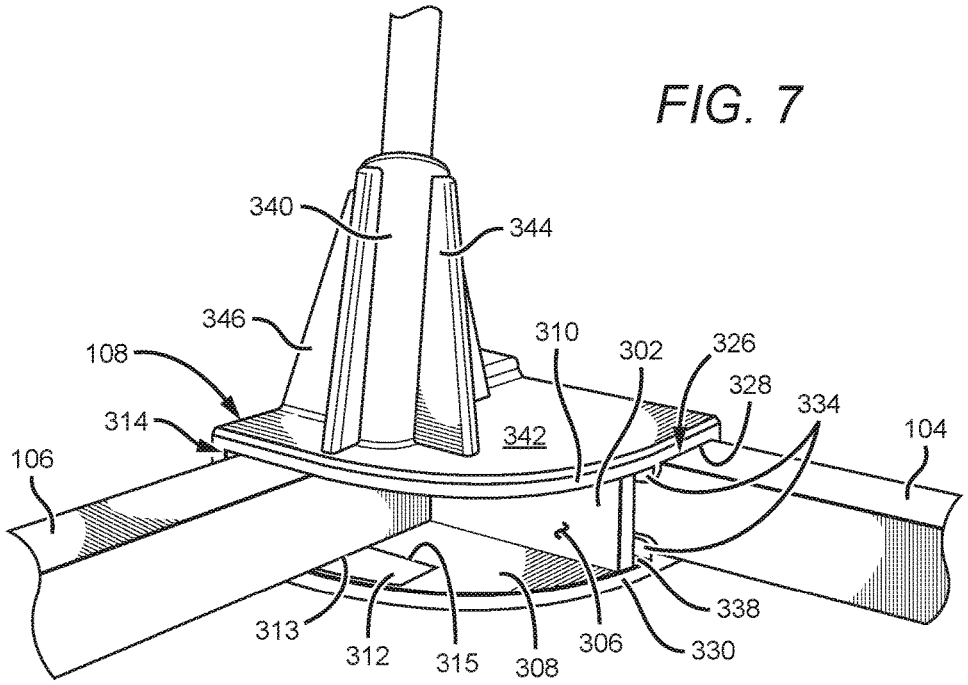
FIG. 7 is a perspective view of a base extension hinge according to an aspect of the disclosure.
Figure 8:
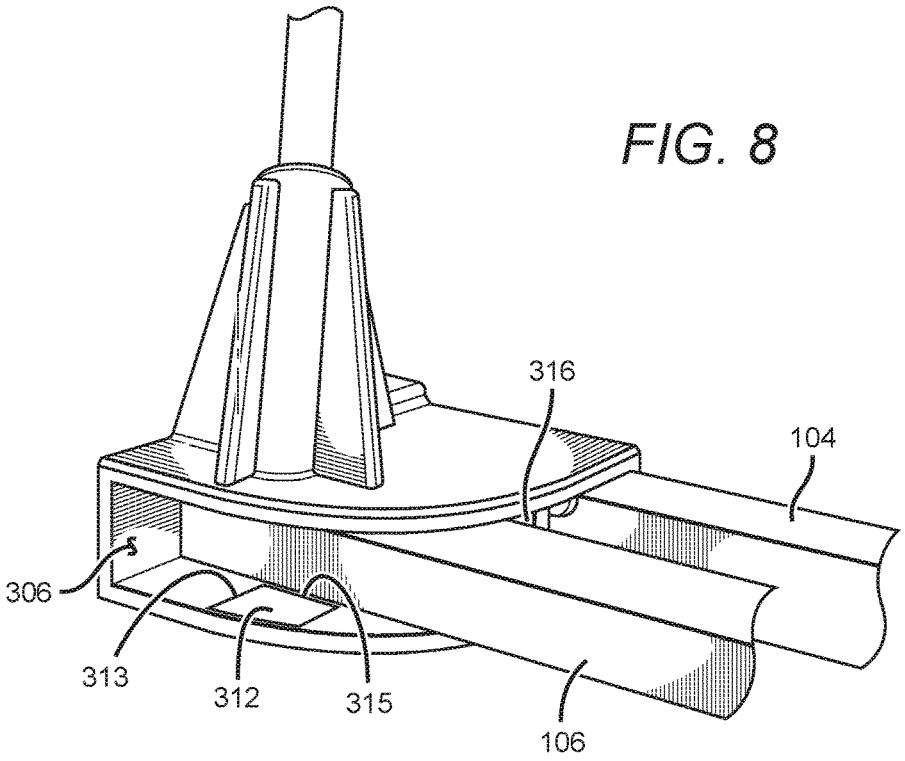
FIG. 8 is another perspective view of the base extension hinge according to an aspect of the disclosure.
Figure 9:
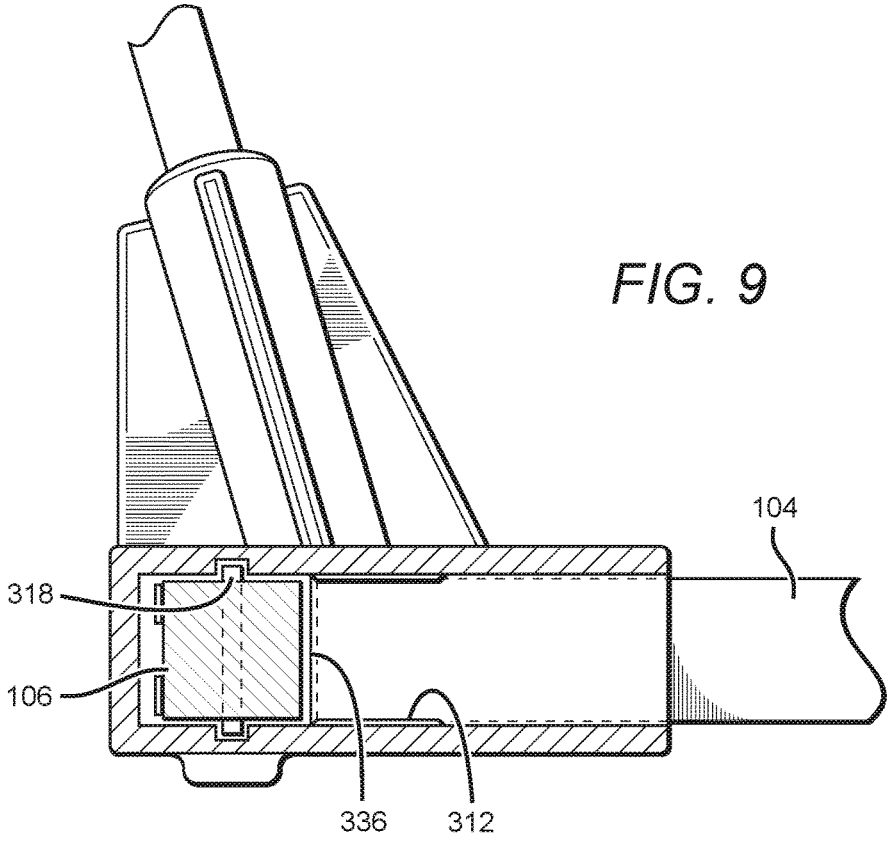
FIG. 9 is a side view of the base extension hinge according to an aspect of the disclosure.

The first base extension hinge 108 comprises at least one groove 302, a pivot 304, and a shaft 340 configured to receive a flexible rod 112, wherein part of the first base extension 106 is received by the first base extension hinge 108 and within the at least one groove 302, such that the first base extension 106 can pivot about the pivot 304 within the at least one groove 302. The base extension hinge 108 comprises at least one groove sidewall 306, a groove base 308, and a groove top 310, wherein the at least one groove sidewall 306 at least partially defines the range of which the first base extension 106 can pivot within the at least one groove 302. The first base extension hinge 108 further comprises a stop 312 within the at least one groove 302, wherein the stop 312 assists in preventing substantial movement of the first base extension 106 within the at least one groove 302. In some aspects, the stop 312 assists in maintaining the position of the first base extension 106 at the ends of the range of pivot motion within the groove 302, such that the first base extension 106 is secured and does not freely move. In some aspects, the range of pivot motion can comprise an opened end 314 wherein the first base extension 106 is deployed, as shown in FIG. 7, and a closed end 316 wherein the first base extension 106 is retracted or collapsed and proximate the first support portion 104, as shown in FIG. 8. The stop 312 provides an obstacle to maintain the positioning of the first base extension 106 at either the opened end 314 or the closed end 316. The stop 312 can be shaped to partially correspond to part of the first base extension 106 received within the groove 302. In some aspects, the stop 312 comprises a first edge 313 that is proximate the first base extension 106 when positioned at the opened end 314. In some aspects, the stop 312 can comprise a second edge 315 that is proximate the first base extension 106 when positioned at the closed end 316. The stop 312 is an elevated or raised structure with respect to the groove base 308 such that the first and second edges 313, 315 provide a physical barrier that assists to maintain the first base extension 106 at either the opened end 314 or the closed end 316. The stop 312 prevents the first base extension 106 from freely moving within the groove 302, and thereby assists in stabilizing the base structure 102. In some aspects, the first and second edges 313, 315 extend from the groove base 308 to the same height. While in other aspects, the first and second edges 313, 315 extend from the groove base 308 to different heights. In some aspects, at least part of the first and second edges 313, 315 can contact part of the first base extension 106 to maintain the position of the first base extension 106. The stop 312 provides some resistance to prevent slight movement of the first base extension 106, but does not prevent the first base extension 106 from moving between the opened end 314 and the closed end 316. The stop 312 can be configured in many different ways and is not intended to be limited to the aspects disclosed herein. In the aspect of FIGS. 7 and 8, the groove 302 comprises one stop 312 on the groove base 308. However, in other aspects, the groove 302 can comprise one or more stops 312 on the groove base 308. In some aspects, the one or more stops 312 can be on the at least one groove sidewall 306, the groove base 308, the groove top 310, and/or a combination thereof. In some aspects, a first stop 312 can be on the groove base 308 and a second stop 312 can be on the groove top 310, such that the first and second stops are opposite each other and substantially aligned.

When the first and second base extensions 106, 118 are positioned at their respective closed end 316 of the groove 302, the base structure 102 is in a closed state and in condition to be stored for later use. When the first and second base extensions are positioned at their respective opened end 314 of the groove 302, the base structure 102 is in a deployed condition and ready to be used. The range of pivot motion of the first and second base extensions is not intended to be limited to the aspects described herein. For example, the range of pivot motion of the first base extension 106 between the closed end 316 and the opened end 314 within the groove 302 can range from about 0 to 90 degrees. However in some aspects, the range of pivot motion of each and/or some of the base extensions from the closed end to the opened end of a respective groove can range from about 0 to 180 degrees. In some aspects the range of pivot motion of the base extensions can be the same, while in other aspects the range of pivot motion can be different for the base extensions.

Figure 10:
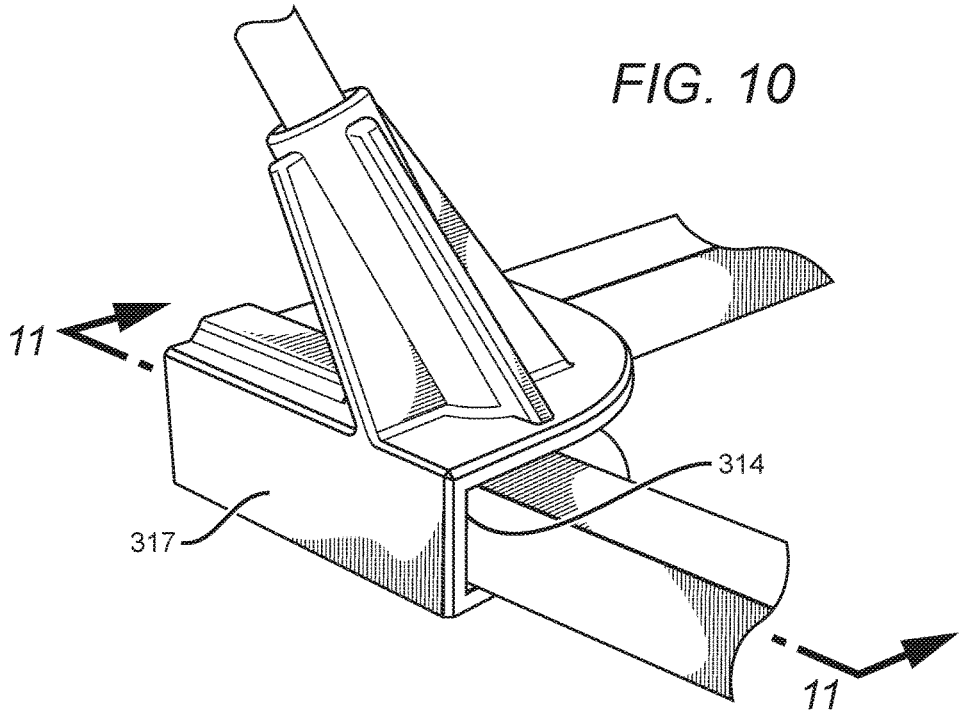
FIG. 10 is another perspective view of the base extension hinge according to an aspect of the disclosure.

The first base extension 106 is coupled to the first base extension hinge 108 by a pin 318, such that the first base extension 106 is adapted to pivot within the groove 302 about the pivot 304. The pivot 304 is at a first position 321 of the first base extension hinge 108, and the first base extension 106 is configured to substantially align the pin 318 with the pivot 304 at the first position 321. Aligning the pin 318 with the pivot 304 allows the first base extension 106 to pivot about the pivot 304 within the groove 302. When the first base extension 106 is pivoted within the groove 302 and positioned at the opened end 314 of the groove 302 such that the pin 318 is substantially aligned with the pivot 304, as shown in FIG. 10, the first base extension 106 is set in a position to engage the locking mechanism within the first base extension hinge 108. The first base extension 106 engaging the locking mechanism within the first base extension hinge 108 substantially locks the first base extension 106 within the first base extension hinge 108, thereby fully deploying the first base extension 106.

Figure 11:
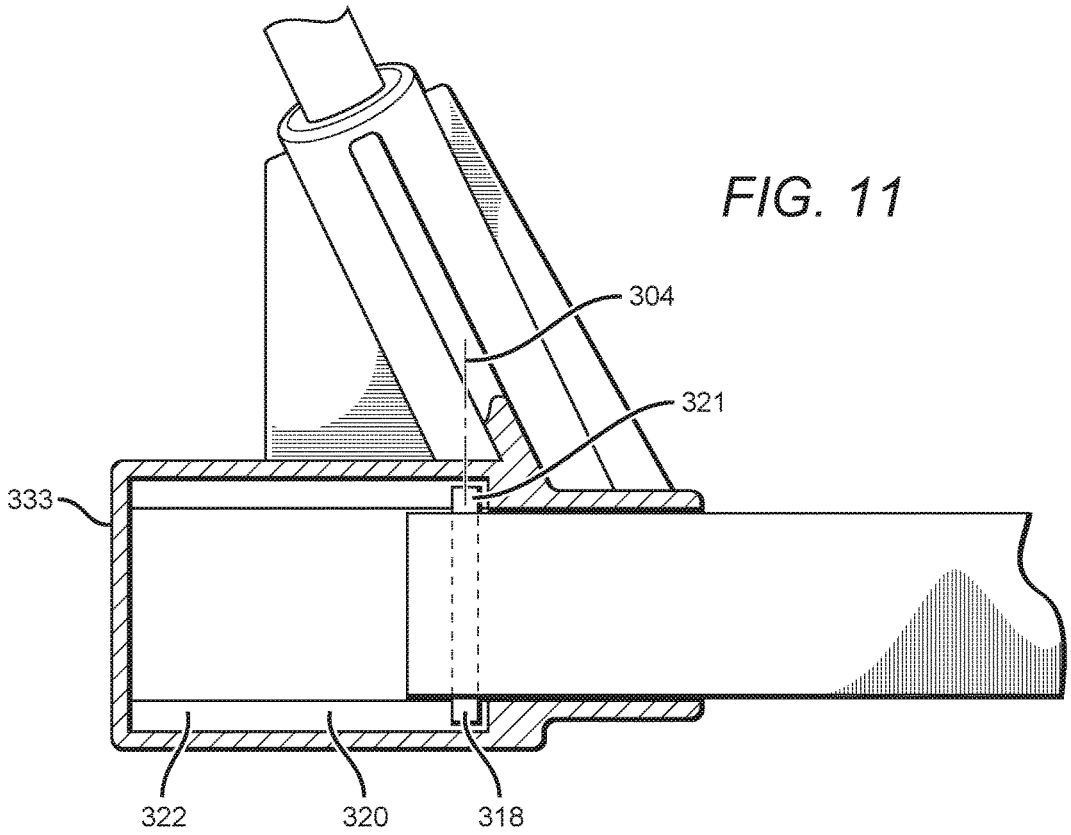
FIG. 11 is a cross-sectional view of the base extension hinge taken about the line 11-11 in FIG. 10, according to an aspect of the disclosure.
Figure 12:
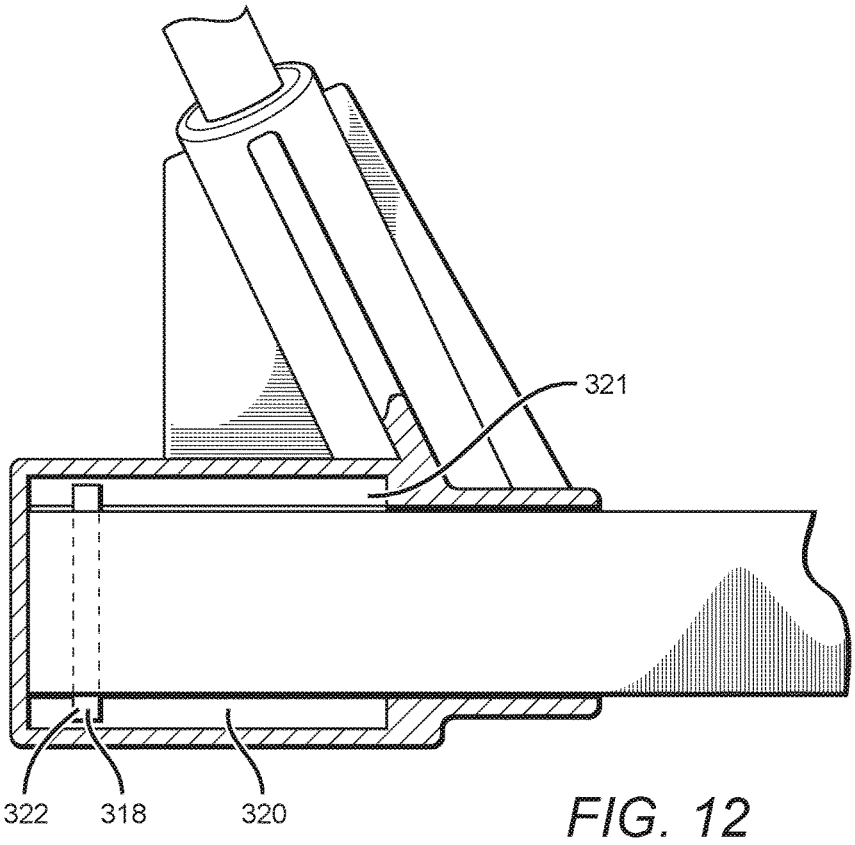
FIG. 12 is another cross-sectional view of the base extension hinge taken about the line 11-11 in FIG. 10, according to an aspect of the disclosure.

With reference to FIGS. 11 and 12, the first base extension hinge 108 can further comprise a channel 319 and at least one trench 320. The channel 319 is configured to receive at least part of the first base extension 106. In the aspects of FIGS. 11 and 12, the channel 319 is shaped to substantially correspond with the shape of the first base extension 106. However, in some aspects, the channel 319 can have a shape that does not substantially correspond to the shape of the first base extension, and is not intended to be limited to the aspects disclosed herein. In some aspects, the channel 319 can have a shape that is different than the shape of the first base extension 106. The at least one trench 320 extends from the pivot 304 or first position 321 towards a trench end 322, wherein the at least one trench 320 is configured to receive part of the pin 318. The at least one trench 320 allows the pin 318 to travel within the at least one trench 320 between the pivot 304 or first position 321 and the trench end 322. The pin 318 extends through the first base extension 106 and into the at least one trench 320 of the first base extension hinge 108, such that the first base extension 106 is arranged to be inserted into the channel 319 and engage the locking mechanism. In the aspect of FIG. 11, the first base extension 106 is positioned at the opened end 314 of the groove 302 such that the pin 318 is at the first position 321, wherein the first base extension 106 is configured to be slidably received within the channel 319 of the first base extension hinge 108 and substantially locked within the first base extension hinge 108. In the aspect of FIG. 12, the first base extension 106 has been inserted into the first base extension hinge 108 and slidably received within the channel 319, such that the pin 318 has traveled within the at least one trench 320 from the first position 321 to the trench end 322. The pin 318 is configured to travel within the at least one trench 320 between the pivot 304 or first position 321 and the trench end 322 within the channel 319, wherein the first base extension 106 is locked and secured when the pin 318 is at the trench end 322. The locking mechanism of the first base extension hinge 108 can be configured in many different ways to substantially lock the first base extension 106 within the first base extension hinge 108. In some aspects, the channel 319 can be tapered from the first position 321 to the trench end 322 such that the channel 319 applies a compression force onto one or more surfaces of the first base extension 106 to lock the first base extension 106 within the channel 319 of the first base extension hinge 108. In some apsects, the at least one trench 320 can be tapered from the first position 321 to the trench end 322 such that the at least one trench 320 applies a compression force onto the pin 318 to lock the first base extension 106 within the channel 319 of the first base extension hinge 108. In some aspects, both the channel 319 and the at least one trench 320 can be tapered to lock the first base extension 106 within the first base extension hinge 108. In yet some aspects, the channel 319 and/or the at least one trench 320 can comprise one or more tabs that extend from the channel and/or the at least one trench that catch and/or abut the pin 318 and/or the first base extension 106 to lock the first base extension 106 within the first base extension hinge 108. In some aspects, the first base extension hinge 108 can comprise a tongue 324 within the channel 319 and proximate the trench end 322, wherein the tongue 324 is received by the first base extension 106 to assist in locking and/or prevent the first base extension 106 from substantially moving. The locking mechanism of the first base extension hinge 108 can be configured to comprise any one or more of the above configurations, and is not intended to be limited to the aspects discloses herein.

In the aspects of FIGS. 11 and 12, the pin 318 extends through opposing surfaces of the first base extension 106 such that a first part of the pin 318 extends from an upper surface of the first base extension, and a second part of the pin 318 extends from a lower surface of the first base extension. The at least one trench 320 comprises two trenches 320 on opposing surfaces of the channel 319, wherein each trench 320 receives the first and second parts of the pin 318. The trenches 320 allows the pin to slidably traverse the trenches, such that the first base extension 106 can be slidably inserted and/or slidably retracted from the first base extension hinge 108. The at least one trench 320 is substantially axially aligned with the first base extension 106 when the first base extension has been pivoted to the opened end 314 of the groove 302, which assists to properly align the first base extension 106 when deployed.

The first base extension hinge 108 further comprises an opening 326 to receive the first support portion 104, as shown in FIG. 7. The opening 326 comprises a top 328, a base 330, a sidewall 332, at least one rib 334, and a back wall 336, wherein the opening 326 is proximate the groove 302 of the first base extension hinge 108. The first support portion 104 is inserted into the opening 326 until the first support portion reaches the back wall 336 of the opening 326. The at least one rib 334 assists in securing the first support portion within the opening 326. In some aspects, the at least one rib 334 can be arranged within the opening 326 such that the opening 326 can accommodate the dimensions of the first support portion 104 that is received within the opening 326. In other aspects, the at least one rib 334 can be arranged within the opening 326 such that part of the first support portion 104 received within the opening 326 at least partially contacts at least one of the top 328, base 330, sidewall 332, and/or a combination thereof. The at least one rib 334 at least partially extends along the length of the opening 326 to the back wall 336. The at least one rib 334 can be a continuous rib. In some aspects, the at least one rib 334 can comprise a plurality of ribs that are separated and aligned to form the at least one rib. In some aspects, the opening 326 can comprise a plurality of ribs 334 that contact part of the first support portion 104 that is received in the opening 326 such that the plurality of ribs 334 prevent the first support portion 104 from shifting and/or moving while in the opening 326. In some aspects, the at least one rib 334 can be on the top 328 and/or base 330. However, the at least one rib 334 can be arranged on many different locations within the opening 326 and is not intended to be limited to the aspects described herein. For example, in some aspects, the at least one rib 334 can be on the sidewall 332, or on the top 328, or on the base 330, or on the back wall 336, and/or a combination thereof. The first base extension hinge 106 can further comprise a lock pin to couple the first support portion 104 within the opening 326. The lock pin can be at a bottom surface of the first base extension hinge 108. However, the lock pin is not intended to be limited to the aspects described herein. In some aspects, the lock pin can be at the top surface or any other surface of the first base extension hinge 108 in order to couple the first support portion 04 to the opening 326. The first support portion can be coupled or fixedly attached to the first base extension hinge 108 using many different fasteners known in the art, and is not intended to be limited to a lock pin.

Figure 14:
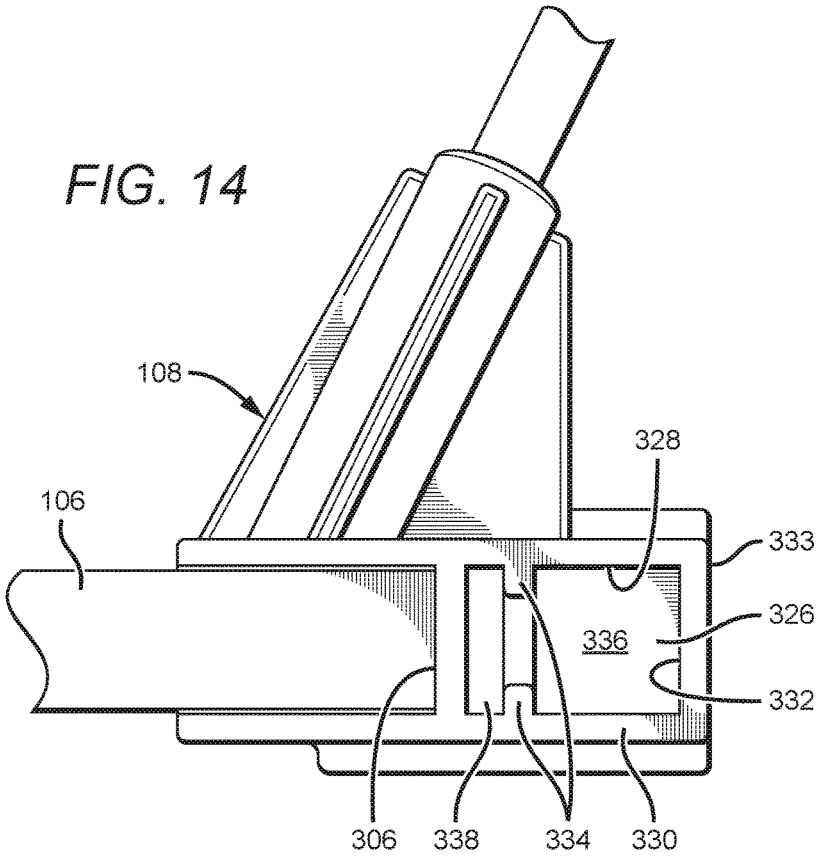
FIG. 14 is another side view of the base extension hinge according to an aspect of the disclosure.

The first base extension hinge 108 can further comprise a cavity 338, wherein the cavity 338 is interposed between the groove 302 and the opening 326. With reference to FIG. 14, the at least one rib 334 separates the opening 326 and the cavity 338. The groove sidewall 306 separates the groove 302 and the cavity 338. The cavity 338 also comprises the back wall 336, such that the back wall 336 is shared between the opening 326 and the cavity 338. The back wall 336 extends between the sidewall 332 of the opening 326 and the groove sidewall 306 of the groove 302. The cavity 338 provides a separation between the opening 326 and the groove 302 to allow for the first support portion 104 to be separated from the first base extension 106 when the first base extension 106 is positioned at the closed end 316 within the groove 302. The separation between the first support portion 104 and the first base extension 106 prevents the first base extension 106 from hitting and/or striking the first support portion 104 when being positioned into and/or when positioned at the closed end 316. The separation assists in preventing damage to either the first support portion 104 and/or the first base extension 106, which can prolong the durability of the ball net structure 100.

At least one advantage of the disclosure is that the back wall 336 of the opening 326 is arranged to assist in securing the first base extension 106 within the first base extension hinge 108. The back wall 336 extends from the sidewall 332 of the opening 326 towards the groove sidewall 306, such that the back wall 336 provides a physical barrier within the channel 319 of the first base extension hinge 108 which assists in preventing the first base extension 106 from moving, pivoting, and/or becoming dislodged when fully received in the channel 319. The back wall 336 provides an extended surface within the channel 319 that can abut part of the first base extension 106 within the channel 319, such that the back wall 336 prevents the first base extension from pivoting. The first base extension 106 does not pivot when positioned proximate the trench end 322 due, in part, to the back wall 336. In addition, the back wall 336 can also withstand at least some of the forces and/or loads exerted onto at least the base extension hinge 108 and/or base extension 106, due to repeated strikes from a ball, bat, kicks from users while using the net, and the like that could cause typical locking buttons/pins to malfunction and/or fail. As such, the disclosure eliminates the need of using a typical locking button/pin.

Figure 13:
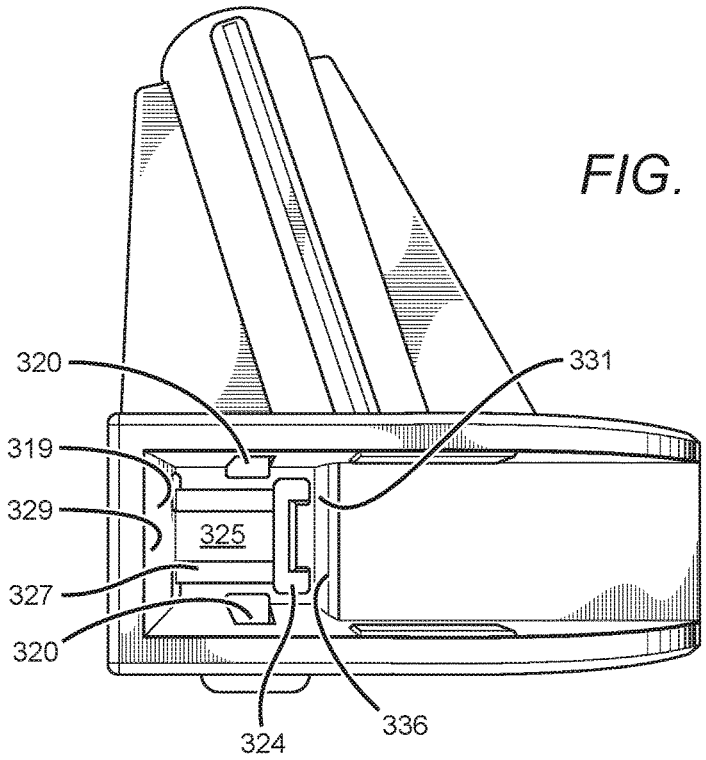
FIG. 13 is another side view of the base extension hinge according to an aspect of the disclosure.
Figure 15:
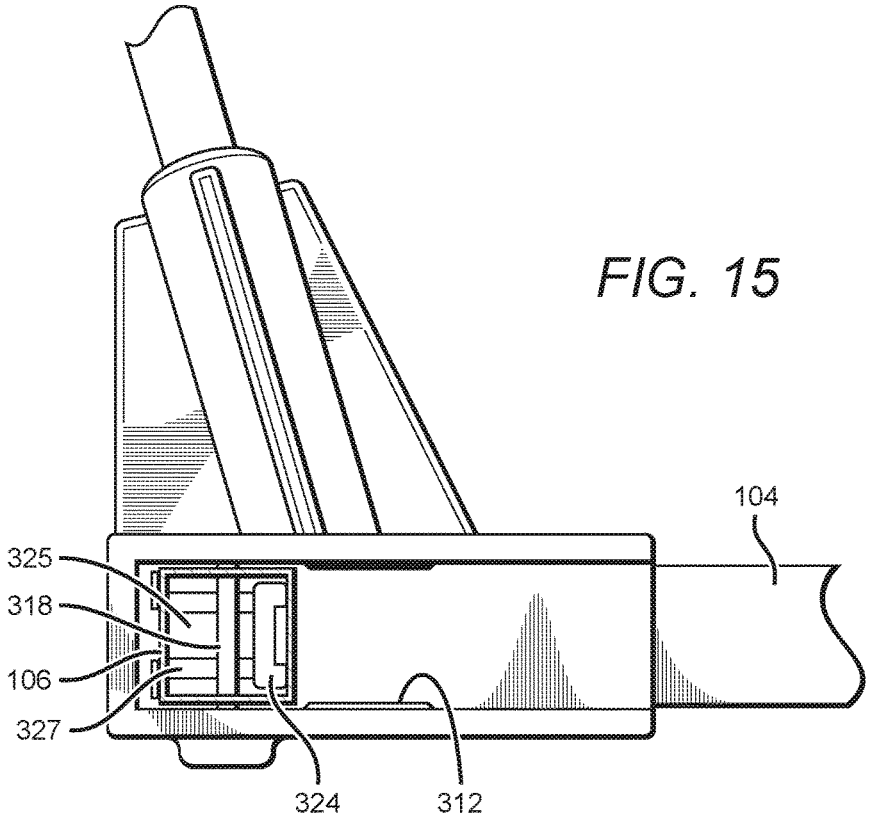
FIG. 15 is another side view of the base extension hinge according to an aspect of the disclosure.

Furthermore, in aspects comprising the tongue 324, for example FIG. 13 or 15, the first base extension 106 comprises a hollow end, wherein the hollow end receives the tongue 324, such that part of the first base extension 106 is interposed between the tongue 324 and the back wall 336. The tongue 324 and back wall 336 configuration cooperate to prevent the first base extension 106 from moving and/or pivoting when interposed between the tongue 324 and back wall 336. The tongue 324 and back wall 336 configuration provide further support against forces and/or loads exerted onto at least the base extension hinge 108 and/or base extension 106. The tongue 324 can extend from any surface within the channel 319 and be proximate the back wall 336, such that the first base extension 106 is interposed between the back wall 336 and the tongue 324. In the aspects of FIGS. 13 and 15, the tongue 324 extends from a back channel wall 325 adjacent the back wall 336 in a direction parallel to the back wall 336. The tongue 324 can comprise at least one finger 327 extending between the tongue 325 and a side channel wall 329 that is opposite the back wall 336 and adjacent the back channel wall 325. The at least one finger 327 assists in providing structural support to the tongue 324. The at least one finger can also extend from the back channel wall 325 and the side channel wall 329 to further assist in providing structural support to the tongue 324. The hollow end of the first base extension 106 can be configured to accommodate the at least one finger 327. In the aspect of FIGS. 13 and 15, the tongue 324 comprises two fingers 327, but the tongue 324 can comprise one or more fingers 327 and is not intended to be limited to the aspects disclosed herein.

The tongue 324 is configured to provide a chamber 331 between the back wall 336 and the tongue 324, wherein the chamber 331 is configured to receive part of the hollow end of the first base extension 106. The chamber 331 receiving part of the hollow end of the first base extension 106 results in the presence of two structures, namely the tongue 324 and the back wall 336, that function to prevent the first base extension 106 from substantially moving. The tongue 324 and/or back wall 336 act as barriers which prevent rotational movement of the first base extension 106 when the hollow end of the first base extension 106 is substantially received within the chamber 331. The tongue 324 and back wall 336 configuration maintain the positioning of the first base extension 106 when fully deployed and the ball net structure 100 is in use. Strikes from users kicking the ball net structure 100 typically occur along the side of the first base extension, which imparts a rotational force onto the first base extension, but the tongue 324 and back wall 336 are able to withstand the force imparted by users kicking the first base extension such that the first base extension remains within the first base extension hinge 108. Even if the first base extension 106 and/or the first base extension hinge 108 and/or any other component of the ball net structure were to receive a strike that caused the first base extension 106 to be released from the tongue/back wall or any other internal locking mechanism of the first base extension hinge 108, the one or more stops 312 can act to at least partially prevent the first base extension 106 from substantial movement. The one or more stops 312 are another form of internal locking mechanism that can be used to hold the first base extension and/or slow down the rate at which the first base extension pivots within the groove. The one or more stops 312 would be helpful in the event that the first base extension 106 was inadvertently released from within the first base extension hinge 108. The hollow end of the first base extension 106 can be released from tongue 324 and back wall 336 via lateral movement, namely sliding the first base extension 106 and pin 318 along the trench 320 until the pin 318 reaches the pivot 304, when so desired to collapse the ball net structure 100. In some aspects, the separation between the tongue 324 and the back wall 336 is constant. In some aspects, the separation between the tongue 324 and the back wall 336 decreases, such that the chamber 331 is tapered. The hollow end of the first base extension 106 when received by the tapered chamber 331 is wedged between the tongue 324 and the back wall 336. At least one advantage of the disclosure is that the first base extension hinge 108 comprises locking features that are internal and are not exposed and/or external to the first base extension hinge 108. The internal locking features, such as but not limited to the trench, the pin, the back wall, tongue, and/or chamber, alone or in combination, operate to lock the extension within the bracket and are able to withstand forces exerted onto the ball net structure 100. Yet another advantage of the disclosure is that the first base extension 106 can be easily locked within the first base extension hinge 108 by sliding the first base extension into the channel of the first base extension hinge. The arrangement of sliding the first base extension into the first base extension hinge allows for the first base extension to be easily locked and released, such that an individual can easily deploy and/or collapse the net structure 100. The arrangement of the first base extension hinge eliminates the need for external locking mechanism that introduce external moving parts that could fail and/or be lost that could render the net structure useless. Conventional locking features are at least partially exposed and are susceptible to failing due to repeated strikes from balls, kicks from users, and/or mechanical failure. The first base extension hinge 108 overcomes the disadvantages of conventional external locking features, and thereby reduces the potential for damage to the ball net structure 100 due to normal usage and also prolongs the durability of the ball net structure 100.

The first base extension hinge 108 can further comprise at least one attachment device (not shown) to assist in stabilizing the ball net structure 100 to a surface. The attachment device can be an extension that extends from a bottom surface of the first base extension hinge, wherein the attachment device is configured to receive an attachment cord adapted to provide additional structural support. The attachment device can be similar to the attachment device 35 discussed above. In some aspects, the attachment device can be arranged to receive part of the net. The at least one attachment device is configured to provide additional structural support to the ball net structure 100 which increases the stability and/or the force the ball net structure 100 can withstand. Furthermore, the at least one attachment device can also be used to maintain the positioning of the ball net structure to prevent shifting of the ball net structure. In some aspects, the ball net structure comprises a plurality of attachment devices and can be on the first support portion 104 and/or the first base extension 106. In yet some aspects, the attachment device can be located on different locations on the first base extension hinge 108 and is not intended to be limited to being at the bottom surface. In yet some aspects, an attachment device can be on at least one of the first support portion 104, first base extension hinge 108, first base extension 106, the base hinge 110, and/or a combination thereof.

With reference to FIG. 7, the first base extension hinge 108 further comprises a shaft 340 extending from a top surface 342 of the first base extension hinge 108. The shaft 340 extends outward in at least a direction towards a back surface 333 of the first base extension hinge 108 opposite the first base extension 106. In some aspects, the shaft 340 can be angled at an angle θ (theta) with respect to the back surface 333 of the first base extension hinge 108. In some aspects, the shaft 340 can be angled at an angle θ within the range of 0 and 90 degrees. The shaft 340 can extend outward with respect to more than one surface of the first base extension hinge 108. In some aspects, the shaft 340 can extend outward in a direction towards the base surface 333 of the base extension hinge 108 and in a direction towards a side surface 317 of the base extension hinge 108. The shaft 340 can be configured to extend out in different directions based on where the shaft 340 is located on the base structure 102, based on the shape of the net 114, and/or where the resultant force from the rods 112 needs to be transferred towards the base structure 102. In some aspects, the shaft 340 can comprise at least one fin 344, wherein the at least one fin 344 provides structural support to the first base extension hinge 108 and/or the shaft 340. The at least one fin 344 can comprise a planar body 346 that is coupled to the shaft 340 and to part of the top surface 342 of the first base extension hinge 108. The at least one fin 344 assists in stabilizing the shaft 340 and to withstand forces exerted onto the shaft 340. The at least one fin 344 can also assist in withstanding forces exerted onto any part of the ball net structure 100, such as but not limited to the base extension hinge, base extension, support portion, and/or any elements of the ball net structure 100. In the aspects of FIGS. 6-15, the shaft 340 comprises four fins 344. However, in other aspects, the shaft 340 can comprise one or more fins 344 and is not intended to be limited to the aspects disclosed herein. In some aspects, the at least one fin 344 can comprise an attachment device 350 (not shown), similarly as disclosed above and/or as shown in FIGS. 16 and 17, discussed below. The attachment device 350 of the at least one fin 344 can be configured to receive the attachment cord as discussed above to stabilize the ball net structure 100. While in other aspects, the attachment device 350 of the at least one fin 344 can receive part of a net 114. The attachment device 350 of the at least one fin 344 can be configured in many different ways and is not intended to be limited to the aspects disclosed herein. In some aspects, the attachment device 350 of the at least one fin 344 can comprise at least one tab extending from the planar body 346. In some aspects, the attachment device 350 of the at least one fin 344 comprises a notch formed within the planar body 346. In yet some aspects, the attachment device 350 of the at least one fin 344 comprises an aperture in the planar body 346 and a stud within the aperture extending from the planar body 346. The shaft 340 is disclosed as extending from the top surface 342 of the first base extension hinge 108, but the disclosure is not intended to be limited to the aspects disclosed herein. In some aspects, the shaft 340 can extend from any surface of the first base extension hinge 108, such as but not limited to a side surface, a bottom surface, or a combination thereof.

The shaft 340 of the first base extension hinge 108 is configured to receive a rod 112. The rod 112 is securely held within the shaft 340 such that the shaft maintains a stable structural connection between the shaft and the rod 112, and prevents the rod from being removed from the shaft when the ball net structure 100 is assembled. In one aspect of the disclosure, the shaft 340 is similarly shaped as the rod 112, such as but not limited to cylindrically shaped, and can be larger than the rod 112 such that the rod can be easily received by and/or removed from the shaft 340. In some aspects, the shaft can comprise a sheath contacting at least part of an inner wall of the shaft that receives the rod. The sheath is adapted to protect the rod within the shaft from forces exerted on the rod. As discussed above in the aspects of FIGS. 1-4, and discussed below, the rods 112 experience a moment force proximate where the rod 112 is received by the shaft 340, and causes the rod to exert a compression force upon the inner surface of the shaft. The sheath, if present, protects the rod from the forces exerted on and/or by the rod.

The shaft 340 can be arranged in many different ways and is not intended to be limited to the aspects disclosed herein. In some aspects, the shaft 340 can comprise a tapered inner surface such that the radius of the shaft decreases as the rod is further inserted into the shaft. In such aspect, the shaft applies a compression force onto the rod to form a structural connection with the rod. In other aspects, mechanical devices, such as but not limited to, screws, nuts, nails, rivets or the like, can be used to form the structural connection to securely attach the rod to the shaft. In yet other aspects, the rods can comprise an attachment device such that the rods can be attached to the shaft; non-limiting examples of such attachment devices are the rods being threaded and screwed into the shaft or the rod and shaft configured similarly like a bayonet-type locking device.

In the aspect of FIG. 5, the rods are circularly shaped and the shaft is also correspondingly circularly shaped to receive the rod. The shape of the rod and shaft is not intended to be limited to a circular shape, other shapes such as quadrilateral, triangular, or any other polygonal shape can be used. The shaft can also be similarly shaped as the rod, but in some aspects, the shaft can be shaped differently than the rod. The rods can be made of many different materials known in the art, such as but not limited to fiberglass or carbon fiber, such that the rods are flexible, elastic, capable of returning to an initial form or state after deformation, and able to withstand the impact forces applied by sports-related balls and/or other projectiles that can be captured or caught by the ball net structure, or thrown, kicked, and/or hit towards the ball net structure.

The angle at which the shaft 340 is angled with respect to at least the back surface 333 of the first base extension hinge 108 causes the rod to extend outward at substantially the same angle as that of the shaft 340. The rods 112, when received by the shaft 340 flare outwards, such that the rods are in a relaxed state and are substantially straight, as shown in FIG. 6. A net 114 is arranged to receive the at least one rod 112 of the ball net structure 100. In some aspects, the net 114 comprises at least one sleeve 113 to receive part of at least one rod 112 of the ball net structure 100. The net 114 is adapted to exert a force on the at least one rod 112 bending the at least one rod into a flexed state. The at least one rod received by the at least one sleeve 113 results in the at least one rod being bent from the relaxed state into a flexed state. In the aspect of FIG. 5, the ball net structure 100 comprises four rods 112, wherein each rod is received by a respective shaft 340 and at least one respective sleeve 113 of the net 114, such that the rods 112 are bent in a direction towards the base structure 102 and into the flexed state. The net tension exerted by the net 114 onto the rods 112 simultaneously pulls the rods into the arcuate state, such that the rods are maintained in the arcuate state when the net structure 100 is fully assembled. Removal of the net 114 from the rods 112 allows the rods to return to their original form of the relaxed state. When the rods 112 are in the relaxed state, the rods can be easily removed from the shaft and allows the ball net structure 100 to be disassembled and stored for later use. Repeated use of the ball net structure does not result in the rods being permanently bent in a shape similar to that of the flexed state. In some aspects, when the rods are in the relaxed state, the base structure can be configured into a different configuration to allow a different net to be used with the base structure.

The net 114 can be configured in a manner that is similar to the net 30, discussed above. The net 114 imparts a pulling force on each of the rods which causes the rods to bend into the arcuate state, such that the rods are bent in a direction towards the base structure. Once bent towards the base structure, the rods are in the flexed or arcuate state and experience a moment force about its pivot point. The rods while in the arcuate state are biased away from the other rods to hold the net upright. The pivot point of each of the rods, in the aspect of FIG. 5, corresponds to the point at which the rods are received by the shaft. The moment force experienced by the rods is imparted and/or transferred onto at least the support portion 602 and the first and second base extensions, with the transferred force being greatest at a central region of the support portion 602. This transferred force further assists in stabilizing the base structure on the surface which the ball net structure is on. The rods can also exert a force onto the base hinge 110 to lock the first and second support portions 104, 116, such that the transferred force prevents rotation of the first and/or second support portion about the respective pivots of the base hinge 110. The ball net structure 100, when fully assembled and deployed, is adapted to withstand the force of a ball or projectile to capture the ball while keeping the support portions locked at the base hinge 110, the first and second base extensions 106, 118 locked within the respective first and second base extension hinges 108, 120 and the ball net structure 100 upright. The base hinge 110 of the ball net structure 100 is similar to the hinge 22 shown in the aspects of at least FIGS. 1-4, wherein the base hinge 110 does not comprise a locking device and is locked due to the forces exerted by the net and/or rods when the ball net structure 100 is fully assembled. As such, the first and second support portions do not pivot about the pivots of the base hinge due to the forces exerted by the net and/or rods.

The net can comprise a mesh surface and/or can be comprised of typical net materials known in the art. The net comprises at least one sleeve 113 to receive a rod. In the aspect of FIG. 5, the net 114 comprises a plurality of sleeves 113 configured in different configurations. At least one pair of sleeves 113 at least partially extend along opposing edges of the net 114 that are configured to receive the rods 112 received by the base extension brackets 200, such that the sleeves 113 are opposite each other. The sleeves 113 that receive the rods 112 from the base extension brackets 200 are elongated sleeves 113 and substantially cover and/or receive all of the rod extending from the base extension brackets 200. Some of the other sleeves 113 of the net 114 can be configured similar to loops and receive part of the rod and/or part of the base structure. The sleeves 113 of the aspect of FIG. 5 are in the form of sleeves of varying sizes that are adapted to receive a respective rod 112 and/or part of the base structure 102. For example, the net comprises front elongated sleeves 113 that receive the rods 112 extending from the base extension brackets 200. The front elongated sleeves 113 are coupled to and extend along part of the edge of the net extending between the base extensions and the upper end 502 of the rods 112 extending from the base extension brackets 200 while covering substantially all of the rods extending from the base extension brackets 200. The net further comprises smaller sleeves or loops proximate the front elongated sleeves, wherein upper loops 113 receive the upper ends 502 of the rods 112 extending from the base extension brackets 200 and lower loops 113 receive the base extensions and/or the base extension bracket 200. The net 114 further comprises rear upper loops 113 that receive an upper end 502 of the rods 112 that extend from the first and second base extension hinges 108, 120 and are proximate a respective corner region of the net. The net 114 further comprises an elongated sleeve 113 along the base of the net that is configured to receive the base structure 102. The elongated sleeve along the base of the net 114 covers substantially all of the first base extension 106, the first and second support portions 104, 116, and the second base extension 118. This elongated sleeve along the base of the net is configured to accommodate the first and second base extension hinges 108, 120 and the base hinge 110, such that the base extension hinges and the base hinge are not covered by the elongated sleeve. The elongated sleeve can be configured to accommodate the base extension bracket 200, such that the sleeve can comprise an opening to allow the base extension bracket 200 to extend out from the elongated sleeve to allow the lower end 504 of the rod to be received by the shaft 340. The elongated sleeve allows the base extension hinges to be exposed and are not covered by the elongated sleeve, to accommodate for the shaft 340 on the base extension hinges. The elongated sleeve also allows the base hinge to be exposed and not covered by the elongated sleeve in order to allow the first and/or second support portions to pivot about the base hinge 110. The base hinge being exposed and uncovered allows the first and/or second support portions to pivot within the base hinge in order to collapse the base structure and store the base net structure with the net remaining on the base structure. This allows the base net structure to be collapsed and stored without having to remove the net from the base structure. The base extension hinges being uncovered by the elongated sleeve also allows the base extensions to pivot within the groove of the base extension hinges in order to collapse the base extensions. The elongated sleeve that receives the base structure comprises at least one strip that allows the base extension hinges and base hinge to be exposed and uncovered by the elongated sleeve. The elongated sleeve comprises two corner strips and a center strip, wherein each corner strip connects the sleeve between the base extensions and the support portions. The corner strips extend behind the base extension hinges exposing the base extension hinges. The center strip connects the sleeve between the first and second support portions and extends behind the base hinge in order to expose the base hinge. The corner and/or center strips are disclosed as extending behind the base extension hinges or the base hinge. However, the disclosure is not intended to be limited to the aspects disclose herein. In some aspects, the corner and/or center strips can extend in front of, under, and/or above the base extension hinges and/or base hinge such that the base extension hinges and/or base hinge are exposed and not covered by the elongated sleeve. The net 114 can comprise at least one seam extending between the corner strip and the upper loop 113 that receive the upper end 502 of the rods from the base extension hinges 108, 120.

In the aspect of FIG. 5, the net 114 comprises a first seam and a second seam, wherein the first seam extends between the corner strip adjacent the first base extension hinge 108 and the upper end 502 of the rod received by the first base extension hinge 108. The second seam extends between the corner strip adjacent the second base extension hinge 120 and the upper end 502 of the rod received by the second base extension hinge 120. The seams assist the net 114 in forming a soccer like goal with distinct net sides and/or net surfaces that are substantially taut and do not substantially sag when the ball net structure 100 is fully assembled.

The front elongated sleeves are adapted to extend along part of the rods that extend from the base extension brackets 200, and the smaller sleeves or loops are adapted to be removably coupled to an end of the rod and/or base structure. The sleeves of the net can be configured in many different configurations and are not intended to be limited to the aspects disclosed herein. In some aspects, the sleeve can span the length of the rod. In other aspects, the sleeve can comprise a plurality of smaller sleeves or loops that are spaced apart from each other and run along part of the rods, or can comprise a sleeve that spans along a partial length of the rod, or can comprise a plurality of sleeves of various lengths. The sleeves of the net can be arranged in many different configurations, such as but not limited to at least one sleeve that extends along a substantial portion of the rod, a plurality of sleeves that extend along part of the rod, or a combination thereof. In some aspects, the sleeves are fixedly attached to the net. In some aspects, the sleeves comprise an attachment mechanism in order to removably couple the sleeves to the rod and/or base structure. In some aspects, the attachment mechanism can comprise a hook and loop system, such that the sleeves are removably coupled via the hook and loop system. In other aspects, the attachment mechanism can comprise a hook, latch, or the like in order to removably couple the sleeve. The sleeves receive the rods and securely hold the net on the rods due in part to the sleeves bending the rods.

The base extension hinges can comprise an extension at a back surface of the base extension hinges that allows for connection of the at least one sleeve to the extension. The extension can be at many different locations on the base extension hinges and is not intended to be limited to the back surface. In other aspects, the extension can be on any part of the base structure, such as but not limited to the first and/or second support portions, the first and/or second base extensions, or a combination thereof. In some aspects, the base structure can comprise a plurality of extensions to allow for the connection of at least one sleeve. In some aspects, the at least one attachment device can also be configured to receive part of the net and/or at least one sleeve. In some aspects, the net can comprise at least one sleeve adapted to receive part of at least one of the first and second support portions. While in other aspects, the net can comprise a plurality of sleeves that receive a respective one of the first and second support portions. The sleeves that receive the support portions can extend along the base or lower edge of the net that is proximate the support portion. The sleeves of the net can be comprised of many different materials, such as but not limited to fabric, plastic, elastic material, rope, cord, or the like.

In the aspect of FIG. 5, the front elongated sleeves and the elongated sleeve that receives the base structure 102 can be configured to give the appearance of a wide and/or solid borders. The wide and/or solid borders can make it easier for users to visually identify the size of the ball net structure. The borders can comprise graphics and/or printed matter to assist in proper alignment of the net during assembly. The borders can provide a visual indication of the profile of the net such that users can identify the boundary of the net that is intended to capture the ball and/or other projectile. The net is held onto the rods and base structure by tension. The tension holds the net substantially taut, such that the net can capture a ball and/or other projectile. The net being substantially taut allows the borders to be easily visible. The net 114 of FIG. 5 is configured to be a soccer goal, wherein the net comprises two sidewalls, a back wall and a top wall. However, the net 114 is not intended to be limited to a soccer goal. The net 114 can be configured to be many different nets, such as but not limited to hockey goals, lacrosse goals, baseball nets, volleyball nets, barrier nets, and the like.

Each rod can comprise an endcap opposite the portion of the rod that is received by the shaft. The endcap is configured to receive at least a portion of the sleeve and/or loop, such that the endcap prevents the net from coming off the rods while the ball net structure is assembled and/or in use. In one aspect, the endcaps comprise a tab and a notch that prevents the net from coming off the rod. For example, the endcap comprises a tab and a notch proximate the tab, such that the notch provides a depressed surface that receives the sleeve and/or loop such that the sleeve and/or loop is securely held by the endcap within the notch. In yet other aspects, the net can comprise a keyhole clip configured to be removably coupled to the endcap. In one aspect, the keyhole clip comprises a housing comprising an opening, a groove, and a cover, wherein the keyhole clip is received by the endcap. In one aspect, the tab of the endcap is received by the opening the keyhole clip and is slidably received with the groove, such that the notch of the endcap is sized to fit and be removably coupled to the groove of the keyhole clip. The keyhole clip is thereby securely held by the endcap and is prevented from coming off the endcap while the ball net structure is assembled and/or in use. The cover of the housing covers the groove and opening, such that when the keyhole clip is received by the endcap, the cover covers the endcap and assists in maintaining the net on the rod. At least one advantage is that the keyhole clip provides for ease of installing and/or coupling the net onto the rods. In addition, the keyhole clip being securely held by the endcap assists in keeping the net on the rods in the event that a ball and/or other projectile hits the net proximate the endcap. However, in other aspects, the endcaps can have other means of preventing the net from coming off the rods, such as but not limited to a hook, loop, locking clip, or the like.

At least one advantage of the disclosure is that the base structure can compensate for forces exerted onto the base structure by the rods while in the flexed state. When the net is coupled and/or received by the rods that are within the respective shafts, the net exerts a pulling force onto the rods, such that the rods are in the flexed state. The rods in the flexed state exert a force onto at least the support portions of the base structure. The base structure can absorb the load exerted onto the support portions due to the rods being in the flexed state and distribute the load across the base structure. In some aspects, the first and/or second support portions can be bent to at least partially raise part of the first and/or second support portions in order to counteract the downward force exerted onto the base structure by the rods bent in the flexed state. In some aspects, the base extensions can be bent to raise the base structure when the base extensions are deployed. In some aspects, the base extension hinges can have at least one angled portion that receives either the base extension and/or the support portions, such that the angled portions cause the support portions and/or the base extensions to lift the base extension hinges when the ball net structure is fully deployed. The base extension hinges are disclosed as having one base extension. However, the base extension hinges can be configured to have more than on base extension and more than one groove, and is not intended to be limited to the aspects disclosed herein.

The base extensions can be configured in many different configurations and are not intended to be limited to the aspects of the disclosure herein. The base extensions of at least FIG. 6 are shown as being straight or linear. However, the base extensions are not intended to be limited to being straight or linear. In some aspects, the base extensions can be bent such that the bent base extensions raise the base structure off the ground or surface by the distance "d" when the base extensions are deployed. The bent base extension could be used with the angled hinge bracket to further assist in lifting the base structure from the ground or surface. In some aspects, the base extensions and/or the support portions can be bent such that the base structure is at least partially raised off the ground or surface. The base extension hinges can further comprise feet that lift the base extension hinges off the ground or surface such that at least the support portions are raised off the ground or surface.

The base extension hinge can be configured in many different configurations and is not intended to be limited to the aspects disclosed herein. For example, in some aspects, the base extension hinge has a circular shape, but in other aspects, the base extension hinge can comprise many different shapes and not limited to a circular shape. In other aspects, the base extension hinge can comprise one groove or more than one groove. For example, the base extension hinge can comprise two grooves and a base extension pivotable within a respective groove. Additionally, the grooves can be set at an angle such that the bottom surface of the base extension hinge is not substantially flat. The angled grooves of the base extension hinge can cause the base extensions to lift the base structure when the base extensions are deployed or positioned at the opened end of the groove. Furthermore, the stop within the groove can be a raised surface that corresponds to the shape of the base extensions to prevent rotation of the base extension within the groove. The base extension hinge can be formed of many different materials. In one aspect, the base extension hinge can be comprised of plastic materials, fabricated using an injection molding process. An advantage of the disclosure is that the base extension hinge is of solid construction and is not formed of separate components that are joined together. The unitary construction of the base extension hinges results in a stronger device and can bear the load of the rods exerted onto the base structure.

FIGS. 16 and 17 show one aspect of a base extension bracket according to the disclosure.

The base structure 102 can further comprise a base extension bracket 200 on the first and second base extensions 106, 118. The base extension bracket 200 is on an end 616, 618 of the base extensions opposite the base extension hinges. The base extension bracket 200 is configured to receive at least one rod 112. The base extension bracket comprises a shaft 340 that can be configured similar to the shaft 340 of the first and second base extension hinges 108, 120. The shaft 340 of the base extension brackets 200 extend outwards in at least a direction away from the opposing first and second support portions. The shafts 340 of the base extension brackets 200 can also be configured to extend outwards in at least a direction away from the opposing base extension bracket 200. The base extension bracket 200 receives at least one rod, wherein the at least one rod is received by the net 114. The base extension bracket 200 can comprise at least one fin 344, as discussed above, and can comprise an attachment device 350. The attachment device 350 can be arranged to be a tab extending from a planar body 346 of a fin 344 such that the tab can receive part of the net 114 and/or an attachment cord that is arranged to stabilize the ball net structure to the surface.

The shaft 340 of the base extension bracket 200 extends from an upper surface 202 of the base extension bracket 200. The at least one fin 344 can be coupled to the shaft and at least the upper surface 202 of the base extension bracket. In some aspects, the at least one fin 344 can also be coupled to a side wall 204 of the base extension bracket 200. In the aspect of FIGS. 16 and 17, the shaft 340 comprises four fins 344, wherein a pair of fins are coupled to the shaft 340 and the upper surface 202 opposite each other. The other pair of fins are coupled to the shaft 340, the upper surface 202, and the side wall 204 and are also opposite each other. The fins 344 provide structural support to the shaft 340 and/or the base extension bracket 200 in a manner similarly to the at least one fin 344 of the base extension hinges, discussed above. The base extension bracket 200 can be fixedly attached to the respective ends 616, 618 of the first and second base extensions. In some aspects, the base extension brackets 200 can be removably coupled to the ends 616, 618 such that a net having a different shape and/or configuration than the net 114 can be used with base structure 102. This allows the base structure 102 to receive many different nets resulting in the base structure 102 being versatile and compatible with different nets such that a user could have different nets but only have one base structure to receive the different nets.

Although the disclosure has been described in considerable detail with reference to certain configurations thereof, other versions are possible. Ball net structures according to the disclosure can be many different sizes and can be used for many different applications, other than for sports-related activities. The ball net structure can comprise net sidewalls to form an enclosure, similar to a soccer goal, lacrosse goal or the like, wherein each base extension comprises a plurality of shafts that receive a respective one of a plurality of rods. The ball net structure can also include a plurality of hinges that lock its base structure to the hinge using the force exerted onto the hinge from the frame structure of the ball net structure. In other aspects, the support portions can be adjustable to make a smaller or bigger base structure, while the size of the rods can also be adjusted to make a smaller or bigger ball net structure. In other aspects, the rods can be made of a single piece of material, whereas in other aspects, the rods can be comprised of a plurality of rod pieces that are joined together to form the rod. Therefore, the spirit and scope of the disclosure should not be limited to the versions described above.

We claim:

1. A net apparatus, comprising:

a support portion having a first end and a second end;

first and second base extensions;

a first base extension hinge coupled to the first end of the support portion, wherein the first base extension is pivotally coupled to the first base extension hinge and configured to engage a locking mechanism within the first base extension hinge, wherein the first base extension hinge comprises:

a groove comprising an opened end and a closed end;

a pivot, wherein the first base extension can pivot within the groove between the opened end and the closed end;

a channel comprising a locking mechanism, wherein the first base extension is configured to engage the locking mechanism to lock the first base extension within the first base extension hinge; and a shaft, wherein the lower end of the first flexible rod is received by the shaft;

a second base extension hinge coupled to the second end of the support portion, wherein the second base extension is pivotally coupled to the second base extension hinge and configured to engage a locking mechanism within the second base extension hinge;

a first flexible rod having an upper end and a lower end, wherein the lower end is removably coupled to the first base extension hinge;

a second flexible rod having an upper end and a lower end, wherein the lower end is removably coupled to the second base extension hinge; and a net, received by at least the first and second flexible rods and by at least the support portion, the net configured to bend the first and second flexible rods from a linear state to a flexed state, such that the first and second flexible rods are biased away from each other by a net tension applied by the net;

wherein the first base extension is adapted to be slidably received by the channel to engage the locking mechanism within the channel wherein the locking mechanism comprises a tongue extending from at least a back wall within the channel, such that part of the first base extension is interposed between the tongue and a side wall of the channel to prevent the first base extension from pivoting within the groove.

2. A net apparatus, comprising:

a support portion having a first end and a second end;

first and second base extensions;

a first base extension hinge coupled to the first end of the support portion, wherein the first base extension is pivotally coupled to the first base extension hinge and configured to engage a locking mechanism within the first base extension hinge, wherein the first base extension hinge comprises:

a groove comprising an opened end and a closed end;

a pivot, wherein the first base extension can pivot within the groove between the opened end and the closed end;

a channel comprising a locking mechanism, wherein the first base extension is configured to engage the locking mechanism to lock the first base extension within the first base extension hinge;

a shaft, wherein the lower end of the first flexible rod is received by the shaft;

at least one stop within the groove between the opened end and the closed end;

a first groove sidewall proximate the closed end; and a second groove sidewall proximate the opened end, wherein the first and second groove sidewalls define the range of pivot motion of the first base extension within the groove;

a second base extension hinge coupled to the second end of the support portion, wherein the second base extension is pivotally coupled to the second base extension hinge and configured to engage a locking mechanism within the second base extension hinge;

a first flexible rod having an upper end and a lower end, wherein the lower end is removably coupled to the first base extension hinge;

a second flexible rod having an upper end and a lower end, wherein the lower end is removably coupled to the second base extension hinge; and a net, received by at least the first and second flexible rods and by at least the support portion, the net configured to bend the first and second flexible rods from a linear state to a flexed state, such that the first and second flexible rods are biased away from each other by a net tension applied by the net.

3. The net apparatus of claim 2, wherein the at least one stop is configured to maintain the position of the first base extension within the groove at the opened end or at the closed end.

* * * * *